US007255178B2

(12) United States Patent
Slup et al.

(10) Patent No.: US 7,255,178 B2
(45) Date of Patent: Aug. 14, 2007

(54) DRILLABLE BRIDGE PLUG

(75) Inventors: Gabriel Slup, Spring, TX (US); Douglas J. Lehr, The Woodlands, TX (US); Hubert F. Garrison, III, Deer Park, TX (US); Tommy J. Allen, Odessa, TX (US); Blake Robin Cox, Midland, TX (US); Donald W. Deel, Sonora, TX (US); Samuel Mark Zimmerman, Midland, TX (US)

(73) Assignee: BJ Services Company, Houston, TX (US)

( * ) Notice: Subject to any disclaimer, the term of this patent is extended or adjusted under 35 U.S.C. 154(b) by 313 days.

(21) Appl. No.: 10/658,979

(22) Filed: Sep. 10, 2003

(65) Prior Publication Data

US 2004/0045723 A1 Mar. 11, 2004

Related U.S. Application Data

(63) Continuation-in-part of application No. 10/146,467, filed on May 15, 2002, now Pat. No. 6,708,770, which is a continuation-in-part of application No. 09/844,512, filed on Apr. 27, 2001, now Pat. No. 6,578,633, which is a continuation-in-part of application No. 09/608,052, filed on Jun. 30, 2000, now Pat. No. 6,491,108.

(51) Int. Cl.
*E21B 33/12* (2006.01)
*E21B 34/06* (2006.01)
*E21B 29/00* (2006.01)

(52) U.S. Cl. ..... 166/386; 166/387; 166/376; 166/317; 166/332.8; 166/133

(58) Field of Classification Search ..... 166/386, 166/373, 316, 321, 332.8, 387, 376, 317, 166/133

See application file for complete search history.

(56) References Cited

U.S. PATENT DOCUMENTS 1,684,266 A 9/1928 Fisher et al.

(Continued)

FOREIGN PATENT DOCUMENTS

EP 0498990 A1 8/1992

(Continued)

OTHER PUBLICATIONS

Website printout "ServaMAP Frac Plug Model FPE" www.mapoiltools.com printed Nov. 22, 2002.

(Continued)

*Primary Examiner*—Kenneth Thompson
(74) *Attorney, Agent, or Firm*—Howrey LLP

(57) ABSTRACT

A method and apparatus for use in a subterranean well is described. The apparatus typically includes a mandrel and a packing element. The mandrel may have an outer surface and a non-circular cross-section and a the packing element may be arranged about the mandrel, the packing element having a non-circular inner surface matching the mandrel outer surface such that concentric rotation between the mandrel and the packing element is precluded. The apparatus may include slips having cavities to facilitate removal of the apparatus. The apparatus also may include a valve for controlling fluid flow through a hollow mandrel. The valve may include a flapper having at least one tab to engage at least one recession in the mandrel such that rotation between the mandrel and the valve is precluded when the valve is in a closed position. The apparatus may further include a central member which is releaseably attached to the mandrel by a release mechanism.

35 Claims, 16 Drawing Sheets

U.S. PATENT DOCUMENTS

| | | | | |
|---|---|---|---|---|
| RE21,677 | E | 12/1940 | Tremolada | |
| 2,331,532 | A | 10/1943 | Bassinger | |
| 3,076,509 | A | 2/1963 | Burns et al. | |
| 3,094,170 | A * | 6/1963 | Bourne, Jr. | 166/321 |
| 3,189,316 | A * | 6/1965 | Preston, Jr. | 251/74 |
| 3,298,385 | A * | 1/1967 | Jackson et al. | 137/112 |
| 3,299,955 | A | 1/1967 | Page, Jr. | |
| 3,375,874 | A * | 4/1968 | Vonner et al. | 166/114 |
| 3,479,829 | A | 11/1969 | Goodman | |
| 3,481,397 | A * | 12/1969 | Baker | 166/320 |
| 3,550,683 | A | 12/1970 | Conreaux | |
| 3,687,196 | A | 8/1972 | Mullins | |
| 3,720,264 | A | 3/1973 | Hutchison | |
| 3,727,691 | A | 4/1973 | Muecke et al. | |
| 3,750,749 | A | 8/1973 | Giroux | |
| 3,828,852 | A | 8/1974 | Delano | |
| 3,867,984 | A | 2/1975 | Dufrene | |
| 3,971,436 | A | 7/1976 | Lee | |
| 4,151,875 | A | 5/1979 | Sullaway | |
| 4,162,619 | A | 7/1979 | Nixon, Jr. | |
| 4,185,690 | A | 1/1980 | Kinney | |
| 4,188,999 | A | 2/1980 | Amancharla | |
| 4,190,111 | A | 2/1980 | Davis | |
| 4,258,788 | A | 3/1981 | Patton et al. | |
| 4,266,620 | A | 5/1981 | Wolgamott et al. | |
| 4,313,497 | A | 2/1982 | Graham | |
| 4,349,071 | A | 9/1982 | Fish | |
| 4,393,930 | A | 7/1983 | Ross et al. | |
| 4,401,161 | A | 8/1983 | Warren | |
| 4,427,065 | A | 1/1984 | Watson | |
| 4,436,150 | A | 3/1984 | Barker | |
| 4,467,867 | A | 8/1984 | Baker | |
| 4,478,286 | A | 10/1984 | Fineberg | |
| 4,479,548 | A | 10/1984 | Gilbert | |
| 4,520,879 | A | 6/1985 | MacElvain | |
| 4,589,495 | A | 5/1986 | Langer et al. | |
| 4,597,449 | A * | 7/1986 | Keeney | 166/373 |
| 4,646,829 | A | 3/1987 | Barrington et al. | |
| 4,708,202 | A | 11/1987 | Sukup et al. | |
| 4,722,389 | A | 2/1988 | Arnold | |
| 4,796,707 | A | 1/1989 | Halbardier | |
| 4,834,184 | A | 5/1989 | Streich et al. | |
| 4,836,279 | A | 6/1989 | Freeman | |
| 4,972,908 | A | 11/1990 | Braddick | |
| 4,986,361 | A | 1/1991 | Mueller et al. | |
| 5,020,597 | A | 6/1991 | Braddick et al. | |
| 5,048,612 | A | 9/1991 | Cochran | |
| 5,117,915 | A | 6/1992 | Mueller et al. | |
| 5,137,090 | A * | 8/1992 | Hare et al. | 166/325 |
| 5,181,571 | A | 1/1993 | Mueller et al. | |
| 5,211,224 | A | 5/1993 | Bouldin | |
| 5,224,540 | A | 7/1993 | Streich et al. | |
| 5,271,468 | A | 12/1993 | Streich et al. | |
| 5,318,131 | A | 6/1994 | Baker | |
| 5,332,038 | A | 7/1994 | Tapp et al. | |
| 5,390,737 | A | 2/1995 | Jacobi et al. | |
| 5,413,172 | A | 5/1995 | Laurel | |
| 5,449,040 | A | 9/1995 | Milner et al. | |
| 5,451,084 | A | 9/1995 | Jansch | |
| 5,540,279 | A | 7/1996 | Branch et al. | |
| 5,669,448 | A | 9/1997 | Minthorn et al. | |
| 5,701,959 | A | 12/1997 | Hushbeck et al. | |
| 5,829,531 | A | 11/1998 | Hebert et al. | |
| 5,839,515 | A | 11/1998 | Yuan et al. | |
| 5,865,251 | A | 2/1999 | Rebardi et al. | |
| 5,984,007 | A | 11/1999 | Yuan et al. | |
| 6,167,963 | B1 | 1/2001 | McMahan et al. | |
| 6,220,348 | B1 | 4/2001 | Serafin et al. | |
| 6,220,349 | B1 | 4/2001 | Vargus et al. | |
| 6,244,642 | B1 | 6/2001 | Serafin et al. | |
| 6,311,778 | B1 | 11/2001 | Carisella et al. | |
| 6,328,109 | B1 * | 12/2001 | Pringle et al. | 166/373 |
| 6,354,372 | B1 | 3/2002 | Carisella et al. | |
| 6,390,190 | B2 | 5/2002 | Mullins | |
| 6,394,180 | B1 | 5/2002 | Berscheidt et al. | |
| 6,491,108 | B1 | 12/2002 | Slup et al. | |
| 6,491,116 | B2 | 12/2002 | Berscheidt et al. | |
| 6,578,633 | B2 | 6/2003 | Slup et al. | |
| 6,581,681 | B1 | 6/2003 | Zimmerman et al. | |
| 2002/0029880 | A1 | 3/2002 | Slup et al. | |
| 2002/0066577 | A1 | 6/2002 | Dewey et al. | |
| 2002/0096365 | A1 | 7/2002 | Berscheidt et al. | |
| 2002/0148615 | A1 * | 10/2002 | Szarka et al. | 166/332.4 |
| 2004/0000407 | A1 * | 1/2004 | Hernandez et al. | 166/386 |
| 2005/0257936 | A1 | 11/2005 | Lehr | |

FOREIGN PATENT DOCUMENTS

| | | |
|---|---|---|
| WO | WO01/09480 | 2/2001 |

OTHER PUBLICATIONS

Website printout "Mod A Ball Check Cement Retainer" www.alphatx.com printed Nov. 22, 2002.
"Big Bore Frac Plug" Alpha Oil Tools, 1996, 1997.
"QUIK Drill Composite Frac Plug" Baker Oil Tools, Copyright 2003.
Halliburton's "FAS DRILL" product sheets (FAS DRILL® Frac Plug, © 1999 Halliburton Energy Services, Inc.; FAS DRILL® Squeeze Packers and Sliding-Valve Packers, © 1997 Halliburton Energy Services, Inc.; FAS DRILL® Bridge Plugs, © 1997 Halliburton Energy Services, Inc.).
Baker, "A Primer of Oilwell Drilling", Sixth Edition, published by Petroleum Extension Service in cooperation with International Association of Drilling Contractors, 2001; first published 1951.
Long, Improved Completion Method for Mesaverde-Meeteetse Wells in the Wind River Basin, SPE 60312, Copyright 1999.
Savage, "Taking New Materials Downhole—The Composite Bridge Plug", PNEC 662,935 (1994).
Guoynes, "New Composite Fracturing Plug Improves Efficiency in Coalbed Methane Completions" SPE 40052, Copyright 1998.
Baker Hughes' web page for "QUIK Drill™ Composite Bridge Plug" (Jul. 16, 2002).
Baker Service Tools Catalog, p. 26, [date unknown] "Compact Bridge Plug Model P-1."
Baker Service Tools Catalog, p. 6, Unit No. 4180, Apr. 26, 1985, "E-4 Wireline Pressure Setting Assembly."
Baker Oil Tools Catalog, 1998, "Quik Drill Composite Bridge Plug."
Baker Service Tools Catalog, p. 26, [date unknown] "Model T Compact Wireline Bridge Plug."
Baker Service Tools Catalog, p. 24 [date unknown] "Model S, N-1, and NC-1 Wireline Bridge Plugs."
Society of Petroleum Engineers Article SPE 23741; © 1992.
Baker Sand Control Catalog for Gravel Pack Systems; © 1988.
Offshore Technology Conference papers OTC 7022, "Horizontal Well Completing, Oseberg Gamma North," Bjorkeset et al.; © 1992.
"Water-packing Techniques Successful in Gravel Packing High-Angle Wells," Douglas J. Wilson and Mark F. Barrilleaux, Oil and Gas Journal © 1991.
Baker Prime Fiberglass Packer Prod. 739-09 data sheet.
Jun. 1968 World Oil Advertisement, p. 135 for Baker All-Fiberglass Packer.
Society of Plastics, www.socplas.org.
"Tape-laying precision industrial shafts", by Debbie Stover, Senior Editor; High-Performance Composites Jul./Aug. 1994.
European Patent Office's Combined Search Search and Examination Report dated Jun. 29, 2004.

* cited by examiner

DRILLABLE BRIDGE PLUG

CROSS-REFERENCE TO RELATED APPLICATIONS

This application is a continuation-in-part of application Ser. No. 10/146,467, filed May 15, 2002, now U.S. Pat. No. 6,708,770 entitled "Drillable Bridge Plug", which is a continuation-in-part application of Ser. No. 09/844,512, filed Apr. 27, 2001, now U.S. Pat. No. 6,578,633 entitled "Drillable Bridge Plug," which is a continuation-in-part of application Ser. No. 09/608,052, filed Jun. 30, 2000, now U.S. Pat. No. 6,491,108 entitled "Drillable Bridge Plug," all of which are incorporated herein in their entireties by reference.

BACKGROUND OF THE INVENTION

1. Field of the Invention

This invention relates generally to methods and apparatus for drilling and completing subterranean wells and, more particularly, to methods and apparatus for a drillable bridge plug, frac plug, cement retainer, and other related downhole apparatus, including apparatus for running these downhole apparatus.

2. Description of Related Art

There are many applications in well drilling, servicing, and completion in which it becomes necessary to isolate particular zones within the well. In some applications, such as cased-hole situations, conventional bridge plugs such as the Baker Hughes model T, N1, NC1, P1, or S wireline-set bridge plugs are inserted into the well to isolate zones. The bridge plugs may be temporary or permanent; the purpose of the plugs is simply to isolate some portion of the well from another portion of the well. In some instances perforations in the well in one portion need to be isolated from perforations in another portion of the well. In other situations there may be a need to use a bridge plug to isolate the bottom of the well from the wellhead. There are also situations where these plugs are not used necessarily for isolation but instead are used to create a cement plug in the wellbore which may be used for permanent abandonment. In other applications a bridge plug with cement on top of it may be used as a kickoff plug for side-tracking the well.

Bridge plugs may be drillable or retrievable. Drillable bridge plugs are typically constructed of a brittle metal such as cast iron that can be drilled out. One typical problem with conventional drillable bridge plugs is that without some sort of locking mechanism, the bridge plug components tend to rotate with the drill bit, which may result in extremely long drill-out times, excessive casing wear, or both. Long drill-out times are highly undesirable as rig time is typically charged for by the hour.

Another typical problem with conventional drillable plugs is that the conventional metallic construction materials, even though brittle, are not easy to drill through. The plugs are generally required to be quite robust to achieve an isolating seal, but the materials of construction may then be difficult to drill out in a reasonable time. These typical metallic plugs thus require that significant weight be applied to the drill-bit in order to drill the plug out. It would be desirable to create a plug that did not require significant forces to be applied to the drill-bit such that the drilling operation could be accomplished with a coiled tubing motor and bit; however, conventional metallic plugs do not enable this.

In addition, when several plugs are used in succession to isolate a plurality of zones within the wellbore, there may be significant pressures on the plug from either side. It would be desirable to design an easily drilled bridge plug that is capable of holding high differential pressures on both sides of the plug. Also, with the potential for use of multiple plugs in the same wellbore, it would be desirable to create a rotational lock between plugs. A rotational lock between plugs would facilitate less time-consuming drill outs.

Additionally, it would be desirable to design an easily drillable frac plug that has a valve to allow fluid communication through the mandrel. It would be desirable for the valve to allow fluid to flow in one direction (e.g. out of the reservoir) while preventing fluid from flowing in the other direction (into the reservoir). It is also desired to design an easily drillable cement retainer that includes a mandrel with vents for circulating cement slurry through the tool.

It is also desired to provide a wire line adapter kit that will facilitate the running of the drillable downhole tool, but still be releasable from the tool. Once released, the wire line adapter kit should be retrievable thus allowing the downhole tool to be drilled. Preferably, the wire line adapter kit should leave little, if any, metal components downhole, thus reducing time milling and/or drilling time to remove plugs.

Additionally, in some downhole operations, it is desirable that a downhole tool function as a bridge plug for some period of time to plug the hole, and subsequently operate as a frac plug or cement retainer which controls fluid flow through the tool. For these applications, a bridge plug is set which prevents fluid flow therethrough, the bridge plug is removed, and subsequently a frac plug or cement retainer is set for controlling fluid flow therethrough. Prior art downhole tools do not allow the same tool to be converted from a bridge plug to a frac plug. Prior art bridge plugs therefore must be removed, either by drilling or milling them out or by retrieving them to the surface, and subsequently setting the frac plug or cement retainer downhole. Not only does this require twp tools, but the time required to remove the bridge plug and set the frac plug or cement retainer may be costly to the operation.

Therefore, in one embodiment of the present invention, a downhole tool is described that can selectively operate as a bridge plug in some instances and subsequently act as a frac plug or cement retainer in others, without the need for setting two tools or removing the first before setting the second.

Further, in typical downhole operations, the frac plug is removed. It has been discovered that when it is desired to remove the prior art frac plugs or cement retainers, the flapper may tend to rotate within the mandrel with the mill or drill bit, thus increasing the removal time. Typical frac plugs are hinged within the mandrel. Once the hinge is milled or drilled out in these prior art flappers, the flapper is free to rotate with the drill bit or mill within the mandrel, thus making the remainder of the removal of the flapper time-intensive. Therefore, it is desirable to provide a downhole tool which is easily removed by milling or drilling, in which the flapper does not rotate with the mill or drill during removal.

The present invention is directed to overcoming, or at least reducing the effects of, one or more of the issues set forth above.

SUMMARY OF THE INVENTION

In one embodiment a subterranean apparatus is disclosed. The apparatus may include a mandrel having an outer surface and a non-circular cross-section and a packing element arranged about the mandrel, the packing element having a non-circular inner surface such that rotation between the mandrel and the packing element is precluded. The mandrel may include non-metallic materials, for example carbon fiber.

In one embodiment, the apparatus exhibits a non-circular cross-section that is hexagonally shaped. The interference between the non-circular outer surface of the mandrel and the inner surface of the packing element comprise a rotational lock.

In one embodiment the apparatus includes an anchoring assembly arranged about the mandrel, the anchoring assembly having a non-circular inner surface such that rotation between the mandrel and the anchoring assembly is precluded. The anchoring assembly may further include a first plurality of slips arranged about the non-circular mandrel outer surface, the slips being configured in a non-circular loop such that rotation between the mandrel and the slips is precluded by interference between the loop and the mandrel outer surface shape. The first plurality of slips may include non-metallic materials. The first plurality of slips may each include a metallic insert mechanically attached to and/or integrally formed into each of the plurality of slips wherein the metallic insert is engageable with a wellbore wall. The anchoring assembly may also include a first cone arranged about the mandrel, the first cone having a non-circular inner surface such that rotation between the mandrel and the first cone is precluded by interference between the first cone inner surface shape and the mandrel outer surface shape. The first plurality of slips abuts the first cone, facilitating radial outward movement of the slips into engagement with a wellbore wall upon traversal of the plurality of slips along the first cone. In this embodiment, the first cone may include non-metallic materials. At least one shearing device may be disposed between the first cone and the mandrel, the sharing device being adapted to shear upon the application of a predetermined force.

The anchoring assembly of the apparatus may further include a second plurality of slips arranged about the non-circular outer surface of the mandrel, the second plurality of slips, the slips being configured in a non-circular loop such that rotation between the mandrel and the slips is precluded by interference between the loop and the mandrel outer surface shape. The second plurality of slips may include non-metallic materials. The second plurality of slips may each include a metallic insert mechanically attached to and/or integrally formed therein with the metallic inserts being engageable with the wellbore wall. The anchoring assembly may also include a second cone arranged, which may or may not be collapsible, about the non-circular outer surface of the mandrel, the second cone having a non-circular inner surface such that rotation between the mandrel and the second cone is precluded by interference between the second cone inner surface shape and the mandrel outer surface shape, wherein the second plurality of slips abuts the second cone, facilitating radial outward movement of the slips into engagement with the wellbore wall upon traversal of the plurality of slips along the second cone. The second cone may include non-metallic materials. The second collapsible cone may be adapted to collapse upon the application of a predetermined force. The second collapsible cone may include at least one metallic insert mechanically attached to and/or integrally formed therein, the at least one metallic insert facilitating a locking engagement between the cone and the mandrel. The anchoring assembly may include at least one shearing device disposed between the second collapsible cone and the mandrel, the at least one shearing device being adapted to shear upon the application of a predetermined force.

In one embodiment the packing element is disposed between the first cone and the second cone. In one embodiment a first cap is attached to a first end of the mandrel. The first cap may include non-metallic materials. The first cap may be attached to the mandrel by a plurality of non-metallic pins.

In one embodiment the first cap may abut a first plurality of slips. In one embodiment the packing element includes a first end element, a second end element, and a elastomer disposed therebetween. The elastomer may be adapted to form a seal about the non-circular outer surface of the mandrel by expanding radially to seal with the wall of the wellbore upon compressive pressure applied by the first and second end elements.

In one embodiment the apparatus may include a second cap attached to a second end of the mandrel. The second cap may include non-metallic materials. The second cap may be attached to the mandrel by a plurality of non-metallic pins. In this embodiment, the second cap may abut a second plurality of slips. In one embodiment the first end cap is adapted to rotationally lock with a second mandrel of a second identical apparatus such as a bridge plug.

In one embodiment the apparatus includes a hole in the mandrel extending at least partially therethrough. In another embodiment the hole extends all the way through the mandrel. In the embodiment with the hole extending all the way therethrough, the mandrel may include a valve arranged in the hole facilitating the flow of cement or other fluids, gases, or slurries through the mandrel, thereby enabling the invention to become a cement retainer.

In one embodiment there is disclosed a subterranean apparatus including a mandrel having an outer surface and a non-circular cross-section, and an anchoring assembly arranged about the mandrel, the anchoring assembly having a non-circular inner surface such that rotation between the mandrel and the anchoring assembly is precluded as the outer surface of the mandrel and inner surface of the packing element interfere with one another in rotation.

In one embodiment there is disclosed a subterranean apparatus including a mandrel; a first cone arranged about an outer diameter of the mandrel; a first plurality of slips arranged about first cone; a second cone spaced from the first cone and arranged about the outer diameter of the mandrel; a second plurality of slips arranged about the first cone; a metallic insert disposed in an inner surface of the second cone and adjacent to the mandrel; a packing element disposed between the first and second cones; with the first and second pluralities of slips being lockingly engageable with the wall of a wellbore and the metallic insert being lockingly engageable with the mandrel. In-this embodiment the second cone may be collapsible onto the mandrel upon the application of a predetermined force. The mandrel, cones, and slips may include non-metallic materials. In addition, a cross-section of the mandrel is non-circular and the inner surfaces of the cones, slips, and packing element are non-circular and may or may not match the outer surface of the mandrel.

In one embodiment there is disclosed a slip assembly for use on subterranean apparatus including: a first cone with at least one channel therein; a first plurality of slips, each having an attached metallic insert, the first slips being arranged about the first cone in the at least one channel of the first cone; a second collapsible cone having an interior surface and an attached metallic insert disposed in the interior surface; a second plurality of non-metallic slips, each having an attached metallic insert, the second slips being arranged about the second cone; with the second non-metallic collapsible cone being adapted to collapse upon the application of a predetermined force. In this embodiment the first and second pluralities of slips are adapted to traverse first and second cones until the slips lockingly engage with a wellbore wall. The insert of the second non-metallic cone is adapted to lockingly engage with a mandrel upon the collapse of the cone. Each of first and second cones and first and second pluralities of slips may include non-metallic materials.

There is also disclosed a method of plugging or setting a packer in a well. The method may include the steps of: running an apparatus into a well, the apparatus comprising a mandrel with a non-circular outer surface and a packing element arranged about the mandrel; setting the packing element by the application force delivered from conventional setting tools and means including, but not limited to: wireline pressure setting tools, mechanical setting tools, and hydraulic setting tools; locking the apparatus in place within the well; and locking an anchoring assembly to the mandrel. According to this method the apparatus may include a first cone arranged about the outer surface of the mandrel; a first plurality of slips arranged about the first cone; a second cone spaced from the first cone and arranged about the outer diameter of the mandrel; a second plurality of slips arranged about the second cone; a metallic insert disposed in an inner surface of the second cone and adjacent to the mandrel; with the first and second pluralities of slips being lockingly engageable with the wall of a wellbore and the metallic insert being lockingly engageable with the mandrel. The first and second cones may include a plurality of channels receptive of the first and second pluralities of slips. Also according to this method, the step of running the apparatus into the well may include running the apparatus such as a plug on wireline. The step of running the apparatus into the well may also include running the apparatus on a mechanical or hydraulic setting tool. The step of locking the apparatus within the well may further include the first and second pluralities of slips traversing the first and second cones and engaging with a wall of the well. The step of locking the anchoring assembly to the mandrel may further include collapsing the second cone and engaging the second cone metallic insert with the mandrel.

There is also disclosed a method of drilling out a subterranean apparatus such as a plug including the steps of: running a drill into a wellbore; and drilling the apparatus; where the apparatus is substantially non-metallic and includes a mandrel having a non-circular outer surface; and a packing element arranged about the mandrel, the packing element having a non-circular inner surface matching the mandrel outer surface. According to this method, the step of running the drill into the wellbore may be accomplished by using coiled tubing. Also, drilling may be accomplished by a coiled tubing motor and bit.

In one embodiment there is disclosed an adapter kit for a running a subterranean apparatus including: a bushing adapted to connect to a running tool; a setting sleeve attached to the bushing, the setting sleeve extending to the subterranean apparatus; a setting mandrel interior to the setting sleeve; a support sleeve attached to the setting mandrel and disposed between the setting mandrel and the setting sleeve; and a collet having first and second ends, the first end of the collet being attached to the setting mandrel and the second end of the collet being releaseably attached to the subterranean apparatus. According to this adapter kit the subterranean apparatus may include an apparatus having a packing element and an anchoring assembly. The subterranean apparatus may include a plug, cement retainer, or packer. The anchoring assembly may be set by the transmission of force from the setting sleeve to the anchoring assembly. In addition, the packing element may be set by the transmission of force from the setting sleeve, through the anchoring assembly, and to the packing element. According to this embodiment the collet is locked into engagement with the subterranean apparatus by the support sleeve in a first position. The support sleeve first position may be facilitated by a shearing device such as shear pins or shear rings. The support sleeve may be movable into a second position upon the application of a predetermined force to shear the shear pin. According to this embodiment, the collet may be unlocked from engagement with the subterranean apparatus by moving the support sleeve to the second position.

In one embodiment there is disclosed a bridge plug for use in a subterranean well including: a mandrel having first and second ends; a packing element; an anchoring assembly; a first end cap attached to the first end of the mandrel; a second end cap attached to the second end of the mandrel; where the first end cap is adapted to rotationally lock with the second end of the mandrel of another bridge plug. According to this embodiment, each of mandrel, packing element, anchoring assembly, and end caps may be constructed of substantially non-metallic materials.

In some embodiments, the first and/or the second plurality of slips of the subterranean apparatus include cavities that facilitate the drilling out operation. In some embodiments, these slips are comprised of cast iron. In some embodiments, the mandrel may be comprised of a metallic insert wound with carbon fiber tape.

Also disclosed is a subterranean apparatus comprising a mandrel having an outer surface and a non-circular cross section, an anchoring assembly arranged about the mandrel, the anchoring assembly having a non-circular inner surface, and a packing element arranged bout the mandrel.

In some embodiments, an easily drillable frac plug is disclosed having a hollow mandrel with an outer surface and a non-circular cross-section, and a packing element arranged about the mandrel, the packing element having a non-circular inner surface such that rotation between the mandrel and the packing element is precluded, the mandrel having a valve for controlling flow of fluids therethrough. In some embodiments, the mandrel may be comprised of a metallic insert wound with carbon fiber tape. In some embodiments, a method of drilling out a frac plug is described.

A wire line adapter kit for running subterranean apparatus is also described as having a adapter bushing to connect to a setting tool, a setting sleeve attached to the adapter bushing, a crossover, a shear ring, a rod, and a collet releaseably attached to the subterranean apparatus. In other aspects, the wire line adapter kit comprises a adapter bushing, a crossover, a body having a flange, a retainer, and a shear sleeve connected to the flange, the shear sleeve having tips.

In some embodiments, a composite cement retainer ring is described having a hollow mandrel with vents, a packing element, a plug, and a collet.

In some embodiments, a subterranean apparatus is disclosed comprising a mandrel having an outer surface and a non-circular cross-section, such as a hexagon; an anchoring assembly arranged about the mandrel, the anchoring assembly having a non-circular inner surface such that rotation between the mandrel and the anchoring assembly is precluded; and a packing element arranged about the mandrel, the packing element having a non-circular inner surface such that rotation between the mandrel and the packing element is precluded. The outer surface of the mandrel and the inner surface of the packing element exhibit matching shapes. Further, the mandrel may be comprised of non-metallic materials, such as reinforced plastics, or metallic materials, such as brass, or may be circumscribed with thermoplastic tape or reinforced with carbon fiber. In some embodiments, the non-circular inner surface of the packing element matches the mandrel outer surface.

In some embodiments, the anchoring assembly comprises a first plurality of slips arranged about the non-circular mandrel outer surface, the slips being configured in a non-circular loop such that rotation between the mandrel and the first plurality of slips is precluded by interference between the loop and the mandrel outer surface shape. The anchoring assembly may comprise a slip ring surrounding the first plurality of slips to detachably hold the first plurality of slips about the mandrel. The slips may be comprised of cast iron, and may contain a cavity and may contain a wickered edge.

Also described is are first and second cones arranged about the mandrel, the first cone comprising a non-circular inner surface such that rotation between the mandrel and the first and second cones is precluded by interference between the first or second cone inner surface shape and the mandrel outer surface shape. The cones may have a plurality of channels to prevent rotation between the cones and the slips. The cones may be comprised of non-metallic materials. The anchoring devices may comprise a shearing device, such as a pin. Also described is a second plurality of slips, which may be similar to the first plurality of slips described above. A packing element may be disposed between the first cone and the second cone. The apparatus may have a first and second end cap attached to either end of the mandrel in various ways. Additional components, such as a booster ring, a lip, an O-ring, and push rings are also described in some embodiments.

In other aspects, a subterranean apparatus is described as a frac plug having a hollow mandrel with a non-circular cross-section; and a packing element arranged about the mandrel, the packing element having a non-circular inner surface such that rotation between the mandrel and the packing element is precluded, the mandrel having a valve for controlling flow of fluid therethrough. The mandrel may have a first internal diameter, a second internal diameter being smaller than the first internal diameter, and a connecting section connecting the first internal diameter and the second internal diameter. The apparatus may have a ball, the connecting section defining a ball seat, the ball adapted to rest in the ball seat thus defining a ball valve to allow fluids to flow in only one direction through the mandrel, the ball valve preventing fluids from flowing in an opposite direction. In some embodiments, the mandrel is comprised of a metallic core wound with carbon fiber tape. The mandrel may have grooves on an end to facilitate the running of the apparatus. Further, the mandrel and the inner surface of the packing element may exhibit matching shapes to precluded rotation between the mandrel and the packing element as the outer surface of the mandrel and the inner surface of the packing element interfere with one another in rotation. The mandrel is described as being metallic or non-metallic.

In some aspects, a method of controlling flow of fluids in a portion of a well is described using the frac plug as well as a method of milling and/or drilling out a subterranean apparatus.

Also disclosed are wire line adapter kits for running a subterranean apparatus. One embodiment includes a adapter bushing, a setting sleeve, a crossover, a shear ring, a collet, and a rod. One embodiment includes a adapter bushing, a setting sleeve, a body, a retainer, and a shear sleeve.

A cement retainer is also described having a non-circular, hollow mandrel with radial vents for allowing fluid communication from an inner surface of the mandrel to an outer surface of the apparatus, a packing element, a plug, and a collet.

A subterranean apparatus is described having a mandrel, a packing element, an anchoring assembly, a first end cap attached to the first end of the mandrel, and a second end cap attached to the second end of the mandrel, wherein the first end cap is adapted to rotationally lock with a top end of another mandrel. Various components of all embodiments are described as comprised of metallic or non-metallic components.

A downhole tool is described having a hollow mandrel having an inner diameter defining a passage therethrough, a packing element arranged about the mandrel, and a valve functionally associated with the mandrel for selectively controlling flow of fluids through the passage, the valve adapted to engage the mandrel such that rotation between the mandrel and the valve is precluded when the valve is in a closed position. The flapper may have at least one tab adapted to selectively engage at least one recession in the mandrel when the valve is in the closed position. The valve may further comprise a hinge, a spring, and a seal. Various forms of the seal are provided.

In another embodiment, the downhole tool has a central member within the passage of the mandrel, the central member being selectively releaseable from the apparatus. The central member may be releaseably attached to the mandrel by a release mechanism. Various forms of the release mechanism are described herein. The central member may be adapted to seal the passage of the apparatus against fluid bypass when the central member is within the mandrel. The passage may allow fluid flow through the apparatus when the central member is released from the mandrel. Various components of the downhole tool may be comprised of non-metallic materials.

In some embodiments, the downhole tool may comprise a mandrel with a non-circular cross-section, the packing element having a non-circular inner surface such that rotation between the mandrel and the packing element is precluded, the outer surface of the mandrel and the inner surface of the packing element interfering with one another in rotation. The tool may have slips which may contain a cavity.

A method of selectively isolating a portion of a well is also described.

In some aspects, a valve is described having a flapper to selectively prevent a flow of fluid through the mandrel and a hinge pivotally attaching the flapper to the mandrel, wherein the flapper has at least one tab adapted to selectively engage the at lease one recession in the mandrel when the valve is in a closed position. A downhole tools such as a cross-flow apparatus is also described having a hollow mandrel, a packing element, a valve, and a central member within the passage of the mandrel, the central member being selectively releaseable from the apparatus.

BRIEF DESCRIPTION OF THE DRAWINGS

The foregoing and other features and aspects of the invention will become further apparent upon reading the following detailed description and upon reference to the drawings in which:

FIG. 21A shows a side view of a slip of one embodiment of the present invention.

FIG. 21B shows a cross-section of a slip having a cavity of one embodiment of the present invention.

FIG. 21C shows a bottom view of a slip of one embodiment of the present invention.

FIG. 21D shows a top view of a slip of one embodiment of the present invention.

Figure 6:
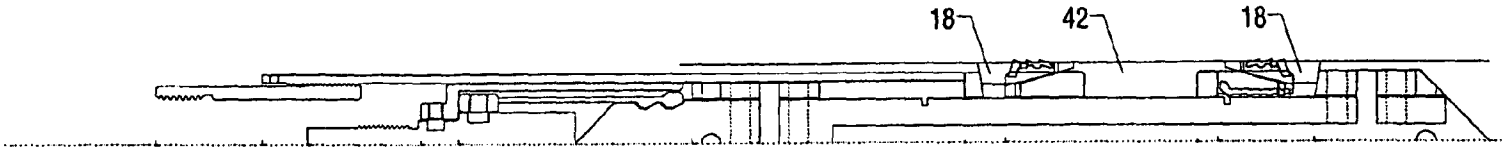
FIG. 6 is a simplified view of the subterranean apparatus and adapter kit according to FIG. 1, shown in a third position.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATIVE EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Figure 2:
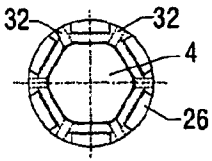
FIG. 2 is a top cross-sectional view of the subterranean apparatus through the upper slip and cone, according to FIG. 1.
Figure 1:
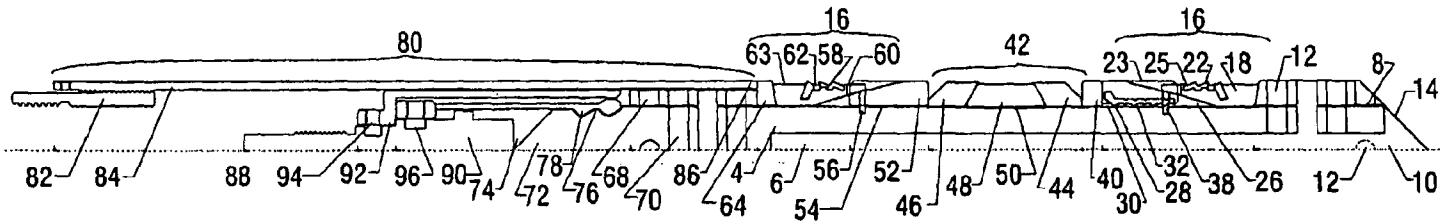
FIG. 1 is a simplified view of a subterranean apparatus and adapter kit assembly positioned in a wellbore according to one embodiment of the present invention.
Figure 13A:
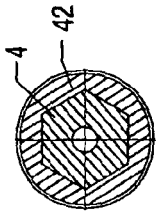
FIG. 13A is a cross-sectional view of the subterranean apparatus assembly according to FIG. 13 taken along line A-A.
Figure 13:
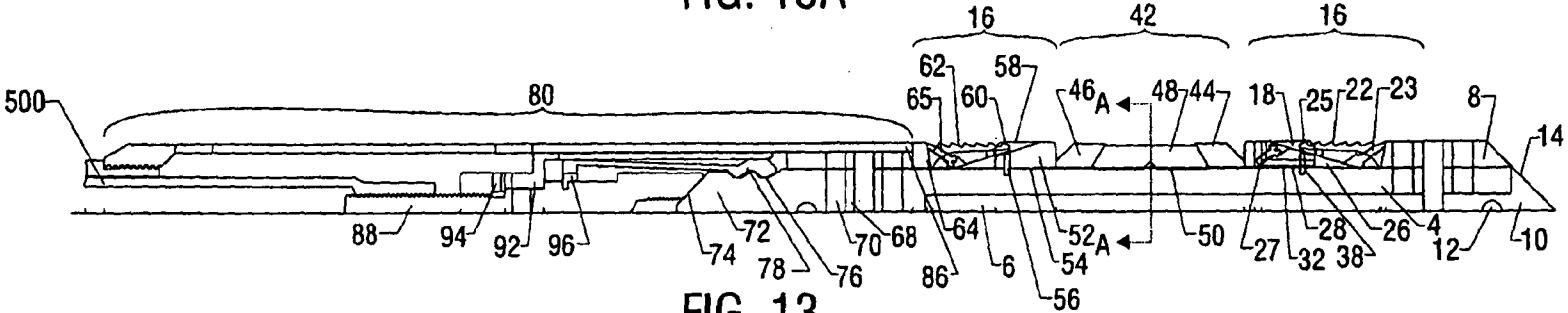
FIG. 13 is a simplified view of the subterranean apparatus assembly and adapter kit according to FIG. 11, shown in a third position.
Figure 14:
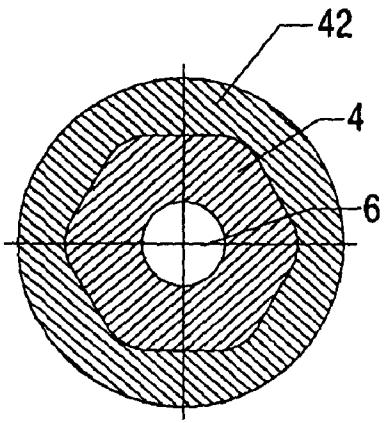
FIG. 14 is a top cross-sectional view of the subterranean apparatus through the mandrel and packing element, an alternative embodiment of the present invention.
Figure 15:
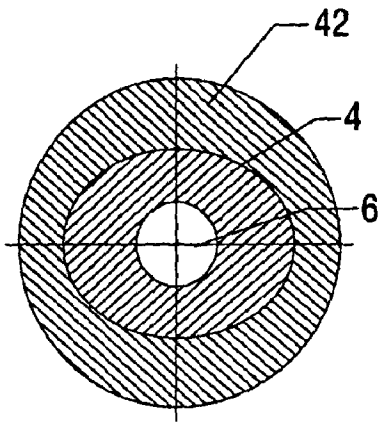
FIG. 15 is a top cross-sectional view of the subterranean apparatus through the mandrel and packing element, according to an alternative embodiment of the present invention.
Figure 16:
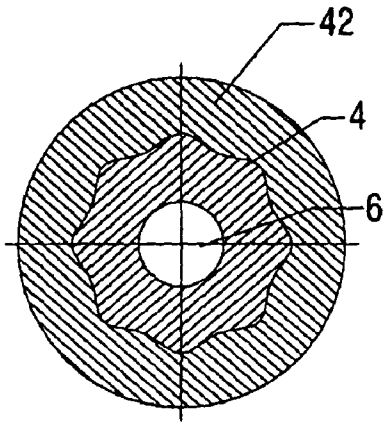
FIG. 16 is a top cross-sectional view of the subterranean apparatus through the mandrel and packing element, according to another alternative embodiment of the present invention.
Figure 17:
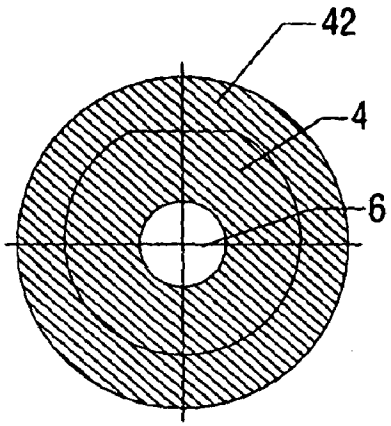
FIG. 17 is a top cross-sectional view of the subterranean apparatus through the mandrel and packing element, according to another alternative embodiment of the present invention.

Turning now to the drawings, and in particular to FIGS. 1 and 13, a subterranean plug assembly 2 in accordance with one embodiment of the disclosed method and apparatus is shown. Plug assembly 2 is shown in the running position in FIGS. 1 and 13. Plug assembly 2 is shown as a bridge plug, but it may be modified as described below to become a cement retainer or other plug. Plug assembly 2 includes a mandrel 4 constructed of non-metallic materials. The non-metallic materials may be a composite, for example a carbon fiber reinforced material or other material that has high strength yet is easily drillable. Carbon fiber materials for construction of mandrel 4 may be obtained from ADC Corporation and others, for example XC-2 carbon fiber available from EGC Corporation. Mandrel 4 has a non-circular cross-section as shown in FIG. 2. The cross-section of the embodiment shown in FIGS. 1-13 is hexagonal; however, it will be understood by one of skill in the art with the benefit of this disclosure that any non-circular shape may be used. Other non-circular shapes include, but are not limited to, an ellipse, a triangle, a spline, a square, or an octagon. Any polygonal, elliptical, spline, or other non-circular shape is contemplated by the present invention. FIGS. 14-17 disclose some of the exemplary shapes of the cross-section of mandrel 4 and the outer components. FIG. 14 discloses a hexagonal mandrel 4, FIG. 15 discloses an elliptical mandrel 4, FIG. 16 discloses a splined mandrel 4, and FIG. 17 discloses a semi-circle and flat mandrel. In one embodiment mandrel 4 may include a hole 6 partially therethrough. Hole 6 facilitates the equalization of well pressures across the plug at the earliest possible time if and when plug assembly 2 is drilled out. One of skill in the art with the benefit of this disclosure will recognize that it is desirable in drilling operations to equalize the pressure across the plug as early in the drilling process as possible.

Mandrel 4 is the general support for each of the other components of plug assembly 2. The non-circular cross-section exhibited by mandrel 4 advantageously facilitates a rotational lock between the mandrel and all of the other components (discussed below). That is, if and when it becomes necessary to drill out plug assembly 2, mandrel 4 is precluded from rotating with the drill, the non-circular cross-section of mandrel 4 prevents rotation of the mandrel with respect to the other components which have surfaces interfering with the cross-section of the mandrel.

Attached to a first end 8 of mandrel 4 is a first end cap 10. First end cap 10 is a non-metallic composite that is easily drillable, for example an injection molded phenolic or other similar material. First end cap 10 may be attached to mandrel 4 by a plurality of non-metallic composite pins 12, and/or attached via an adhesive. Composite pins 12 are arranged in different planes to distribute any shear forces transmitted thereto. First end cap 10 prevents any of the other plug components (discussed below) from sliding off first end 8 of mandrel 4. First end cap 10 may include a locking mechanism, for example tapered surface 14, that rotationally locks plug assembly 2 with another abutting plug assembly (not shown) without the need for a third component such as a key. This rotational lock facilitates the drilling out of more than one plug assembly when a series of plugs has been set in a wellbore. For example, if two plug assemblies 2 are disposed in a wellbore at some distance apart, as the proximal plug is drilled out, any remaining portion of the plug will fall onto the distal plug, and first end cap 10 will rotationally lock with the second plug to facilitate drilling out the remainder of the first plug before reaching the second plug. In the embodiment shown in the figures, first end cap 10 exhibits an internal surface matching the non-circular cross-section of mandrel 4 which creates a rotational lock between the end cap and mandrel; however, the internal surface of the first end cap 10 may be any non-circular surface that precludes rotation between the end cap and mandrel 4. For example, the internal surface of first end cap 10 may be square, while mandrel 4 has an outer surface that is hexagonal or octagonal, but rotation between the two is still advantageously precluded without the need for a third component such as a key.

First end cap 10 abuts an anchoring assembly 16. Anchoring assembly 16 includes a first plurality of slips 18 arranged about the outer diameter of mandrel 4. Slips 18 are arranged in a ring shown in FIG. 3 with the slips being attached to one another by slip ring 20. In the embodiment shown in FIG. 3, there are six slips 18 arranged in a hexagonal configuration to match the cross-section of mandrel 4. It will be understood by one of skill in the art with the benefit of this disclosure that slips 18 may be arranged in any configuration matching the cross-section of mandrel 4, which advantageously creates a rotational lock such that slips 18 are precluded from rotating with respect to mandrel 4. In addition, the number of slips may be varied and the shape of slip ring may be such that rotation would be allowed between the slips and the mandrel—but for the channels 99 (discussed below). Further, the configuration of slip ring 20 may be any non-circular shape that precludes rotation between slips 18 and mandrel 4. For example, the slip ring 20 may be square, while mandrel 4 has an outer surface that is hexagonal or octagonal, but rotation between the two is still precluded. Each of slips 18 is constructed of non-metallic composite materials such as injection molded phenolic, but each slip also includes a metallic insert 22 disposed in outer surface 23. Metallic inserts 22 may each have a wicker design as shown in the figures to facilitate a locked engagement with a casing wall 24. Metallic inserts 22 may be molded into slips 18 such that slips 18 and inserts 22 comprise a single piece as shown in FIG. 1; however, as shown in the embodiment shown in FIGS. 11-13, metallic inserts 22 may also be mechanically attached to slips 18 by a fastener, for example screws 23. Metallic inserts 22 are constructed of low density metallic materials such as cast iron, which may heat treated to facilitate surface hardening such that inserts 22 can penetrate casing 24, while maintaining small, brittle portions such that they do not hinder drilling operations. Metallic inserts 22 may be integrally formed with slips 18, for example, by injection molding the composite material that comprises slips 18 around metallic insert 22.

Anchoring assembly 16 also includes a first cone 26 arranged adjacent to the first plurality of slips 18. A portion of slips 18 rest on first cone 26 as shown in the running position shown in FIGS. 1 and 13. First cone 26 comprises non-metallic composite materials such as phenolics that are easily drillable. First cone 26 includes a plurality of metallic inserts 28 disposed in an inner surface 30 adjacent mandrel 4. In the running position shown in FIGS. 1 and 13, there is a gap 32 between metallic inserts 28 and mandrel 4. Metallic inserts 28 may each have a wicker design as shown in the figures to facilitate a locked engagement with mandrel 4 upon collapse of first cone 26. Metallic inserts 28 may be molded into first cone 26 such that first cone 26 and metallic inserts 28 comprise a single piece as shown in FIG. 1; however, as shown in the embodiment shown in FIGS. 11-13, metallic inserts 28 may also be mechanically attached to first cone 26 by a fastener, for example screws 27. Metallic inserts 28 may be constructed of low density metallic materials such as cast iron, which may be heat treated to facilitate surface hardening sufficient to penetrate mandrel 4, while maintaining small, brittle portions such that the inserts do not hinder drilling operations. For example, metallic inserts 28 may be surface or through hardened to approximately plus or minus fifty-five Rockwell C hardness. Metallic inserts 28 may be integrally formed with first cone 26, for example, by injection molding the composite material that comprises first cone 26 around metallic inserts 28 as shown in FIG. 1; however, as shown in the embodiment shown in FIGS. 11-13, metallic inserts 28 may also be mechanically attached to first cone 26 by a fastener, for example screws 27. Inner surface 30 of first cone 26 may match the cross-section of mandrel 4 such that there is an advantageous rotational lock therebetween. In the embodiment shown in FIGS. 2 and 4, inner surface 30 is shaped hexagonally to match the cross-section of mandrel 4. However, it will be understood by one of skill in the art with the benefit of this disclosure that inner surface 30 of cone 26 may be arranged in any configuration matching the cross-section of mandrel 4. The matching of inner surface 30 and mandrel 4 cross-section creates a rotational lock such that mandrel 4 is precluded from rotating with respect to first cone 26. In addition, however, the inner surface 30 of the first cone 26 may not match and instead may be any non-circular surface that precludes rotation between the first cone and mandrel 4. For example, the inner surface 30 may be square, while mandrel 4 has an outer surface that is hexagonal or octagonal, but rotation between the two is still advantageously precluded without the need for a third component such as a key.

Figure 4:
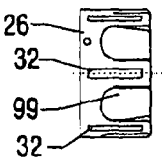
FIG. 4 is a side view of a cone assembly according to one embodiment of the disclosed method and apparatus.
Figure 7:
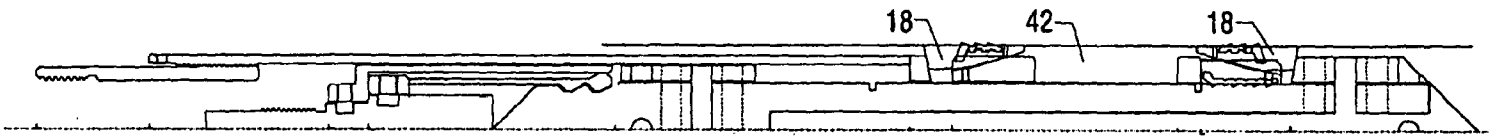
FIG. 7 is a simplified view of the subterranean apparatus and adapter kit according to FIG. 1, shown in a fourth position.
Figure 12:
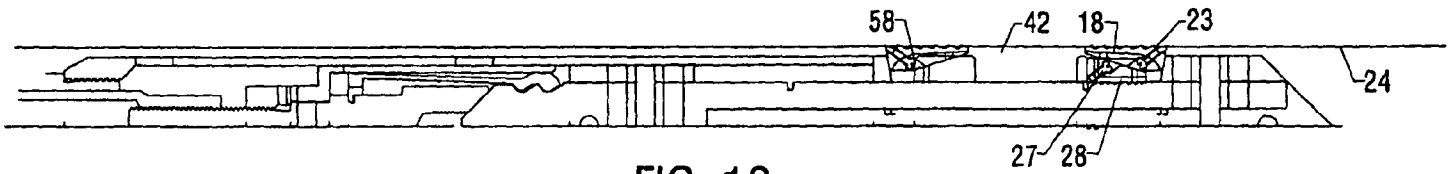
FIG. 12 is a simplified view of the subterranean apparatus assembly and adapter kit according to FIG. 11, shown in a second position.

As shown in FIG. 4, first cone 26 includes a plurality of slots 32 disposed therein, for example six slots. Slots 32 weaken first cone 26 such that the cone will collapse at a predetermined force. The predetermined collapsing force on first cone 26 may be, for example, approximately 4500 pounds; however, first cone 26 may be designed to collapse at any other desirable force. When first cone 26 collapses, as shown in FIGS. 7 and 12, metallic inserts 28 penetrate mandrel 4 and preclude movement between anchoring assembly 16 and mandrel 4. As shown in FIGS. 1 and 13, one or more shearing devices, for example shear pins 38, may extend between first cone 26 and mandrel 4. Shear pins 38 preclude the premature setting of anchoring assembly 16 in the wellbore during run-in. Shear pins 38 may be designed to shear at a predetermined force. For example, shear pins 38 may shear at a force of approximately 1500 pounds; however, shear pins 38 may be designed to shear at any other desirable force. As shear pins 38 shear, further increases in force on first cone 26 will cause relative movement between first cone 26 and first slips 18. FIG. 6 shows the shearing of shear pins 38. The relative movement between first cone 26 and first slips 18 causes first slips 18 to move in a radially outward direction and into engagement with casing wall 24. At some point of the travel of slips 18 along first cone 26, slip ring 20 will break to allow each of slips 18 to engage casing wall 24. For example, slip ring 20 may break between 1500 and 3000 pounds, with slips 18 being fully engaged with casing wall 24 at 3000 pounds. FIGS. 6 and 12 show plug assembly 2 with slips 18 penetrating casing wall 24. FIG. 4 also discloses a plurality of channels 99 formed in first cone 26. Each of channels 99 is associated with its respective slip 18. Channels 99 advantageously create a rotational lock between slips 18 and first cone 26.

First cone 26 abuts a gage ring 40. Gage ring 40 may be non-metallic, comprised, for example, of injection molded phenolic. Gage ring 40 prevents the extrusion of a packing element 42 adjacent thereto. Gage ring 40 includes a non-circular inner surface 41 that precludes rotation between the gage ring and mandrel 4. For example inner surface 41 may be hexagonal, matching a hexagonal outer surface of mandrel 4, but inner surface 41 is not limited to a match as long as the shape precludes rotation between the gage ring and the mandrel.

Packing element 42 may include three independent pieces. Packing element 42 may include first and second end elements 44 and 46 with an elastomeric portion 48 disposed therebetween. First and second end elements 44 and 46 may include a wire mesh encapsulated in rubber or other elastomeric material. Packing element 42 includes a non-circular inner surface 50 that may match the cross-section of mandrel 4, for example, as shown in the figures, inner surface 50 is hexagonal. The match between non-circular surface 50 of packing element 42 and the cross-section of mandrel 4 advantageously precludes rotation between the packing element and the mandrel as shown in any of FIGS. 14-17. However, the non-circular surface 50 of packing element 42 may be any non-circular surface that precludes rotation between the packing element and mandrel 4. For example, the surface 50 may be hexagonal, while mandrel 4 has an outer surface that is octagonal, but rotation between the two is still precluded. Packing element 42 is predisposed to a radially outward position as force is transmitted to the end elements 44 and 46, urging packing element 42 into a sealing engagement with casing wall 24 and the outer surface of mandrel 4. Packing element 42 may seal against casing wall 24 at, for example, 5000 pounds.

End element 46 of packing element 42 abuts a non-metallic second cone 52. Second cone 52 includes non-metallic composite materials that are easily drillable such as phenolics. Second cone 52 is a part of anchoring assembly 16. Second cone 52, similar to first cone 26, may include a non-circular inner surface 54 matching the cross-section of mandrel 4. In the embodiment shown in the figures, inner surface 54 is hexagonally shaped. The match between inner surface 54 precludes rotation between mandrel 4 and second cone 52. However, inner surface 54 may be any non-circular surface that precludes rotation between second cone 52 and mandrel 4. For example, inner surface 54 may be square, while mandrel 4 has an outer surface that is hexagonal or octagonal, but rotation between the two is still precluded. In one embodiment, second cone 52 does not include any longitudinal slots or metallic inserts as first cone 26 does;

however, in an alternative embodiment second cone 52 does include the same elements as first cone 26. Second cone 52 includes one or more shearing devices, for example shear pins 56, that prevent the premature setting of a second plurality of slips 58. Shear pins 56 may shear at, for example approximately 1500 pounds. FIG. 4 also discloses that second cone 52 includes a plurality of channels 99 formed therein. Each of channels 99 is associated with its respective slip 58. Channels 99 advantageously create a rotational lock between slips 58 and second cone 52.

Figure 3:
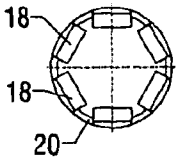
FIG. 3 is a top view of a slip ring according to one embodiment of the disclosed method and apparatus.

Anchoring assembly 16 further includes the second plurality of slips 58 arranged about the outer diameter of mandrel 4 in a fashion similar to the first plurality of slips 18 shown in FIG. 3. Slips 58 (as slips 18 in FIG. 3) are arranged in a ring with the slips being attached to one another by slip ring 60. Similar to the embodiment shown in FIG. 3, there are six slips 58 arranged in a hexagonal configuration to match the cross-section of mandrel 4. It will be understood by one of skill in the art with the benefit of this disclosure that slips 58 may be arranged in any configuration matching the cross-section of mandrel 4, which advantageously creates a rotational lock such that slips 58 are precluded from rotating with respect to mandrel 4. Further, the configuration of slip ring 60 may be any non-circular shape that precludes rotation between slips 58 and mandrel 4. For example, the slip ring 60 may be square, while mandrel 4 has an outer surface that is hexagonal or octagonal, but rotation between the two is still precluded. In addition, the number of slips may be varied and the shape of slip ring may be such that rotation would be allowed between the slips and the mandrel—but for the channels 99. Each of slips 58 may be constructed of non-metallic composite materials, but each slip also includes a metallic insert 62 disposed in outer surface 63. Metallic inserts 62 may each have a wicker design as shown in the figures to facilitate a locked engagement with a casing wall 24. Metallic inserts 62 may be molded into slips 58 such that slips 58 and inserts 62 comprise a single piece as shown in FIG. 1; however, as shown in the embodiment shown in FIGS. 11-13, metallic inserts 62 may also be mechanically attached to slips 58 by a fastener, for example screws 65. Metallic inserts 62 may be constructed of low density metallic materials such as cast iron, which may heat treated to facilitate hardening such that inserts 62 can penetrate casing 24, while maintaining small, brittle portions such that they do not hinder drilling operations. For example, metallic inserts 62 may be hardened to approximately plus or minus fifty-five Rockwell C hardness. Metallic inserts 62 may be integrally formed with slips 58, for example, by injection molding the composite material that comprises slips 58 around metallic insert 62.

Adjacent slips 58 is a ring 64. Ring 64 is a solid non-metallic piece with an inner surface 66 that may match the cross-section of mandrel 4, for example inner surface 66 may be hexagonal. However, inner surface 66 may be any non-circular surface that precludes rotation between ring 64 and mandrel 4. For example, inner surface 66 may be square, while mandrel 4 has an outer surface that is hexagonal or octagonal, but rotation between the two is still precluded Ring 64, like the other components mounted to mandrel 4, may have substantially circular outer diameter. The match between inner surface 66 and the cross-section of mandrel 4 advantageously precludes rotation between ring 64 and mandrel 4.

Ring 64 abuts a second end cap 68. Second end cap 68 may be a non-metallic material that is easily drillable, for example injection molded phenolic or other similar material. Second end cap 68 may be attached to mandrel 4 by a plurality of non-metallic composite pins 70, and/or attached via an adhesive. Composite pins 70 are arranged in different planes to distribute any shear forces transmitted thereto. Second end cap 68 prevents any of the other plug components (discussed above) from sliding off second end 72 of mandrel 4. In the embodiment shown in the figures, second end cap 68 exhibits an internal surface matching the non-circular cross-section of mandrel 4 which creates a rotational lock between the end cap and mandrel; however, the internal surface of the second end cap 68 may be any non-circular surface that precludes rotation between the end cap and mandrel 4. For example, the internal surface of second end cap 68 may be square, while mandrel 4 has an outer surface that is hexagonal or octagonal, but rotation between the two is still precluded. Second end 72 of mandrel 4 may include a locking mechanism, for example tapered surface 74, that rotationally locks plug assembly 2 with another abutting plug assembly (not shown). Tapered surface 74 is engageable with tapered surface 14 of end cap 10 such that rotation between two plugs 2 is precluded when surfaces 74 and 14 are engaged.

Second end 72 of plug 2 includes two grooves 76 extending around mandrel 4. Grooves 76 are receptive of a collet 78. Collet 78 is part of an adapter kit 80. Adapter kit 80 includes a bushing 82 receptive of a setting tool 500 (not shown in FIG. 1, but shown in FIGS. 11-13). Bushing 82 is receptive, for example of a Baker E-4 wireline pressure setting assembly (not shown), but other setting tools available from Owen and Schlumberger may be used as well. The setting tools include, but are not limited to: wireline pressure setting tools, mechanical setting tools, and hydraulic setting tools. Adjacent bushing 82 is a setting sleeve 84. Setting sleeve 84 extends between the setting tool (not shown) and bridge plug 2. A distal end 86 of setting sleeve 84 abuts ring 64. Adapter kit 80 exhibits a second connection point to the setting tool (not shown) at the proximal end 88 of a setting mandrel 90. Setting mandrel 90 is part of adapter kit 80. Setting sleeve 84 and setting mandrel 90 facilitate the application of forces on plug 2 in opposite directions. For example setting sleeve 84 may transmit a downward force (to the right as shown in the figures) on plug 2 while setting mandrel 90 transmits an upward force (to the left as shown in the figures). The opposing forces enable compression of packing element 42 and anchoring assembly 16. Rigidly attached to setting mandrel 90 is a support sleeve 92. Support sleeve 92 extends the length of collet 78 between setting sleeve 84 and collet 78. Support sleeve 92 locks collet 78 in engagement with grooves 76 of mandrel 4. Collet 78 may be shearably connected to setting mandrel 90, for example by shear pins 96 or other shearing device such as a shear ring (not shown).

It will be understood by one of skill in the art with the benefit of this disclosure that one or more of the non-metallic components may include plastics that are reinforced with a variety of materials. For example, each of the non-metallic components may comprise reinforcement materials including, but not limited to, glass fibers, metallic powders, wood fibers, silica, and flour. However, the non-metallic components may also be of a non-reinforced recipe, for example, virgin PEEK, Ryton, or Teflon polymers. Further, in some embodiments, the non-metallic components may instead be metallic component to suit a particular application. In a metallic-component situation, the rotational lock between components and the mandrel remains as described above.

Operation and setting of plug 2 is as follows. Plug 2, attached to a setting tool via adapter kit 80, is lowered into a wellbore to the desired setting position as shown in FIGS.

Figure 5:
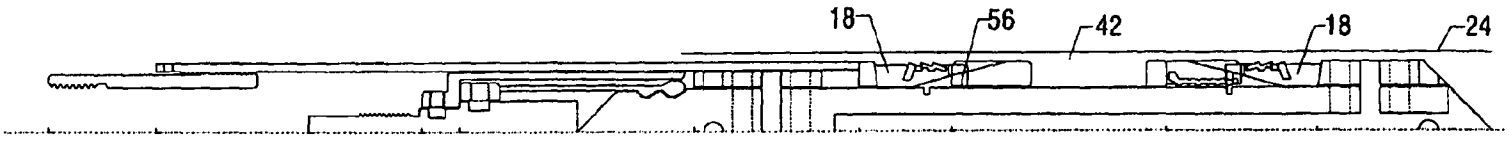
FIG. 5 is a simplified view of the subterranean apparatus and adapter kit according to FIG. 1, shown in a second position.

1 and 13. Bushing 82 and its associated setting sleeve 84 are attached to a first portion of the setting tool (not shown) which supplies a downhole force. Setting mandrel 90, with its associated components including support sleeve 92 and collet 78, remain substantially stationary as the downhole force is transmitted through setting sleeve 84 to ring 64. The downhole force load is transmitted via setting sleeve 84 and ring 64 to shear pins 56 of second cone 52. At a predetermined load, for example a load of approximately 1500 pounds, shear pins 56 shear and packing element 42 begins its radial outward movement into sealing engagement with casing wall 24 as shown in FIG. 5. As the setting force from setting sleeve 84 increases and packing element 42 is compressed, second plurality of slips 58 traverses second cone 52 and eventually second ring 60 breaks and each of second plurality of slips 58 continue to traverse second cone 52 until metallic inserts 62 of each penetrates casing wall 24 as shown in FIGS. 6 and 12. Similar to the operation of anchoring slips 58, the load transmitted by setting sleeve 84 also causes shear pins 38 between first cone 26 and mandrel 4 to shear at, for example, approximately 1500 pounds, and allow first plurality of slips 18 to traverse first cone 26. First plurality of slips 18 traverse first cone 26 and eventually first ring 25 breaks and each of first plurality of slips 18 continue to traverse first cone 26 until metallic inserts 22 of each penetrates casing wall 24. Force supplied through setting sleeve 84 continues and at, for example, approximately 3000 pounds of force, first and second pluralities of slips 18 and 58 are set in casing wall 24 as shown in FIGS. 6 and 12.

Figure 10:
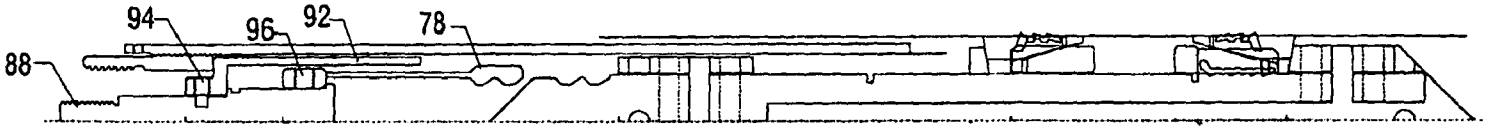
FIG. 10 is a simplified view of the subterranean apparatus and adapter kit according to FIG. 1, shown in a seventh position.
Figure 9:
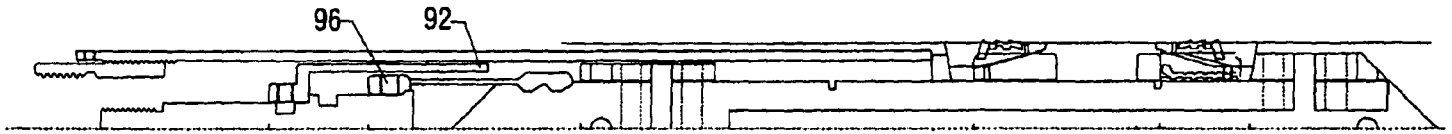
FIG. 9 is a simplified view of the subterranean apparatus and adapter kit according to FIG. 1, shown in a sixth position.
Figure 8:
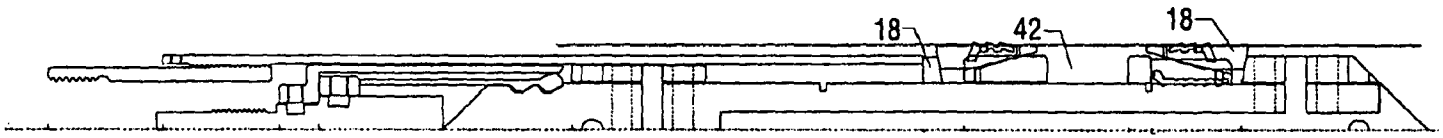
FIG. 8 is a simplified view of the subterranean apparatus and adapter kit according to FIG. 1, shown in a fifth position.
Figure 11:
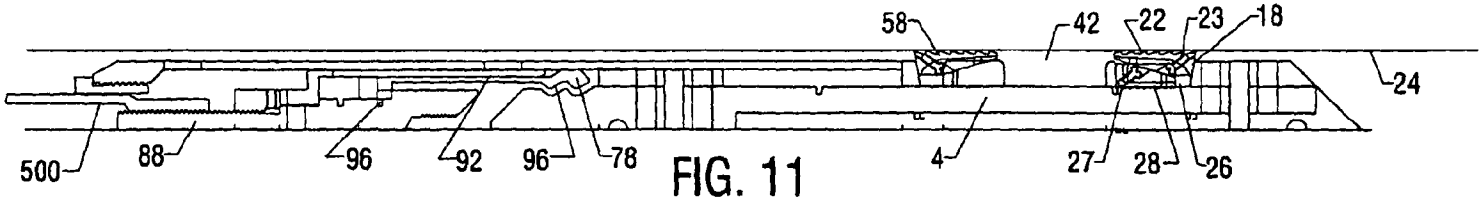
FIG. 11 is a simplified view of a subterranean apparatus and adapter kit assembly positioned in a wellbore according to one embodiment of the present invention.

As the force transmitted by setting sleeve 84 continues to increase, eventually first cone 26 will break and metallic cone inserts 28 collapse on mandrel 4 as shown in FIGS. 7 and 12. First cone 26 may break, for example, at approximately 4500 pounds. As metallic inserts 28 collapse on mandrel 4, the wickers bite into mandrel 4 and lock the mandrel in place with respect to the outer components. Force may continue to increase via setting sleeve 84 to further compress packing element 42 into a sure seal with casing wall 24. Packing element 42 may be completely set at, for example approximately 25,000 pounds as shown in FIG. 8. At this point, setting mandrel 90 begins to try to move uphole via a force supplied by the setting tool (not shown), but metallic inserts 28 in first cone 26 prevent much movement. The uphole force is transmitted via setting mandrel 90 to shear pins 96, which may shear at, for example 30,000 pounds. Referring to FIGS. 9 and 11, as shear pins 96 shear, setting mandrel 90 and support sleeve 92 move uphole. As setting mandrel 90 and support sleeve 92 move uphole, collet 78 is no longer locked, as shown in FIGS. 10 and 11. When collet 78 is exposed, any significant force will snap collet 78 out of recess 76 in mandrel 4 and adapter kit 80 can be retrieved to surface via its attachment to the setting tool (not shown).

With anchoring assembly 16, packing element 42, and first cone metallic insert 28 all set, any pressure build up on either side of plug 2 will increase the strength of the seal. Pressure from uphole may occur, for example, as a perforated zone is fractured.

Figure 20:
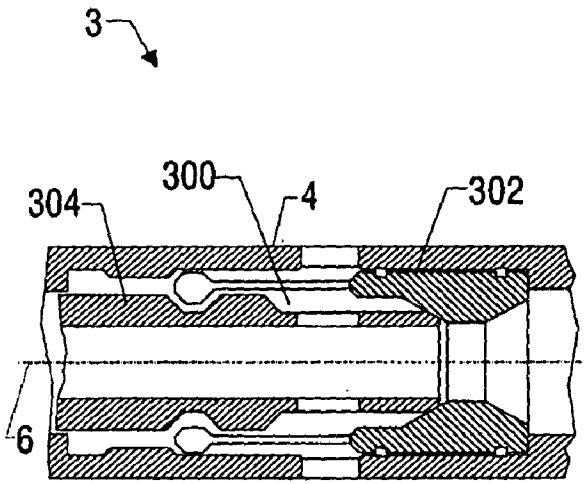
FIG. 20 is a sectional view of the subterranean apparatus according to another alternative embodiment of the present invention.
Figure 19:
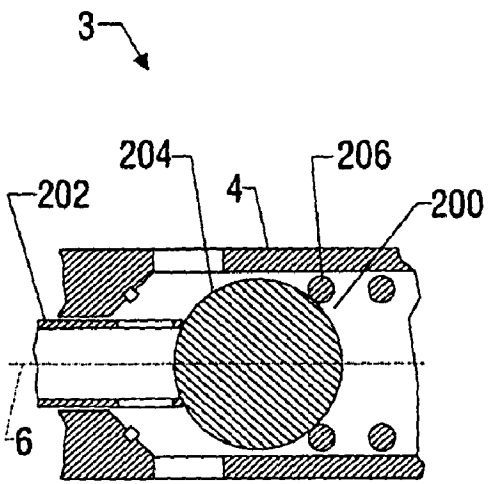
FIG. 19 is a sectional view of the subterranean apparatus according to another alternative embodiment of the present invention.
Figure 18:
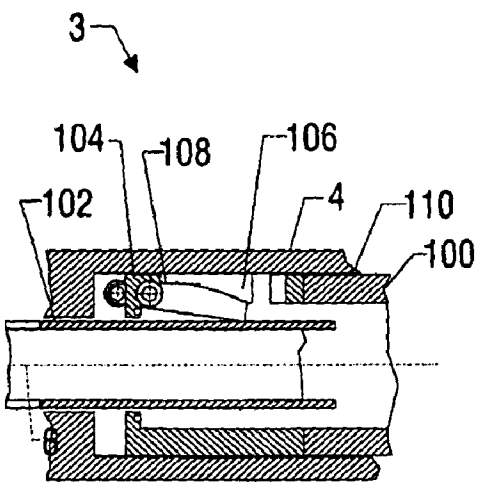
FIG. 18 is a sectional view of the subterranean apparatus according to another alternative embodiment of the present invention.

In an alternative embodiment of the present invention shown in FIGS. 18-20, hole 6 in mandrel 4 may extend all the way through, with a valve such as valves 100, 200, or 300 shown in FIGS. 18-20, being placed in the hole. The through-hole and valve arrangement facilitates the flow of cement, gases, slurries, or other fluids through mandrel 4. In such an arrangement, plug assembly 2 may be used as a cement retainer 3. In the embodiment shown in FIG. 18, a flapper-type valve 100 is disposed in hole 6. Flapper valve 100 is designed to provide a back pressure valve that actuates independently of tubing movement and permits the running of a stinger or tailpipe 102 below the retainer. Flapper valve 100 may include a flapper seat 104, a flapper ring 106, a biasing member such as spring 108, and a flapper seat retainer 110. Spring 108 biases flapper ring 106 in a close position covering hole 6; however a tail pipe or stinger 102 may be inserted into hole 6 as shown in FIG. 18. When tailpipe 102 is removed from retainer 3, spring 108 forces flapper seat 104 closed. In the embodiment shown in FIG. 19, a ball-type valve 200 is disposed in hole 6. Ball valve 200 is designed to provide a back pressure valve as well, but it does not allow the passage of a tailpipe through mandrel 4. Ball valve 200 may include a ball 204 and a biasing member such as spring 206. Spring 206 biases ball 204 to a closed position covering hole 6; however, a stinger 202 may be partially inserted into the hole as shown in FIG. 19. When stinger 202 is removed from retainer 3, spring 206 forces ball 204 to close hole 6. In the embodiment shown in FIG. 20, a slide valve 300 is disposed in hole 6. Slide valve 300 is designed to hold pressure in both directions. Slide valve 300 includes a collet sleeve 302 facilitating an open and a closed position. Slide valve 300 may be opened as shown in FIG. 20. by inserting a stinger 304 that shifts collet sleeve 302 to the open position. As stinger 304 is pulled out of retainer 3, the stinger shifts collet sleeve 302 back to a closed position. It will be understood by one of skill in the art with the benefit of this disclosure that other valve assemblies may be used to facilitate cement retainer 3. The embodiments disclosed in FIGS. 18-20 are exemplary assemblies, but other valving assemblies are also contemplated by the present invention.

Because plug 2 may include non-metallic components, plug assembly 2 may be easily drilled out as desired with only a coiled tubing drill bit and motor. In addition, as described above, all components are rotationally locked with respect to mandrel 4, further enabling quick drill-out. First end cap 10 also rotationally locks with tapered surface 74 of mandrel 4 such that multiple plug drill outs are also advantageously facilitated by the described apparatus.

To further facilitate the drilling out operation, slip 18 and/or slip 58 may include at least one internal cavity. FIGS. 21A-21D illustrate slip 18 or slip 58 having a cavity 33. As previously described, slips 18 are arranged in a ring shown in FIG. 3 with the slips being attached to one another by slip ring 20. In the embodiment shown in FIG. 3, there are six slips 18 arranged in a hexagonal configuration to match the cross-section of mandrel 4. It will be understood by one of skill in the art with the benefit of this disclosure that slips 18 may be arranged in any configuration matching the cross-section of mandrel 4, which advantageously creates a rotational lock such that slips 18 are precluded from rotating with respect to mandrel 4. In addition, the number of slips may be varied and the shape of slip ring may be such that rotation would be allowed between the slips and the mandrel—but for the channels 99 (discussed previously). Further, the configuration of slip ring 20 may be any non-circular shape that precludes rotation between slips 18 and mandrel 4. For example, the slip ring 20 may be square, while mandrel 4 has an outer surface that is hexagonal or octagonal, but rotation between the two is still precluded.

In this embodiment, each of slips 18 is constructed of a brittle, metallic material such as cast iron; however, as would be understood by one of ordinary skill in the art having the benefit of this disclosure, other materials such as ceramics could be utilized. Further, each slip may include a wickered surface to facilitate a locked engagement with a casing wall 24.

Figure 21A:
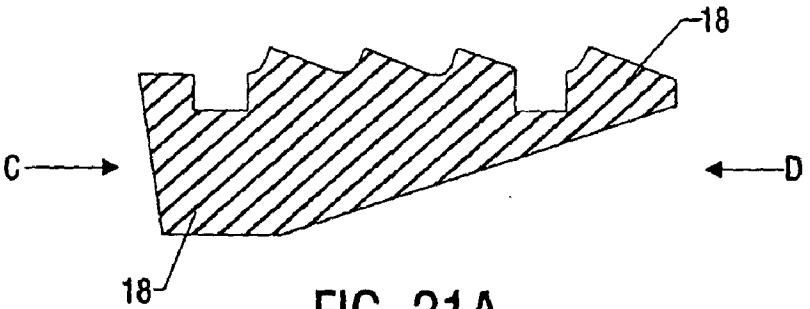
FIGS. 21A-21D show sectional views of the slips of one embodiment of the present invention.
Figure 21B:
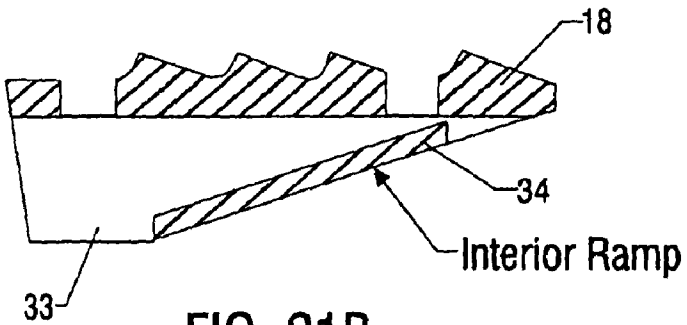
Figure 21C:
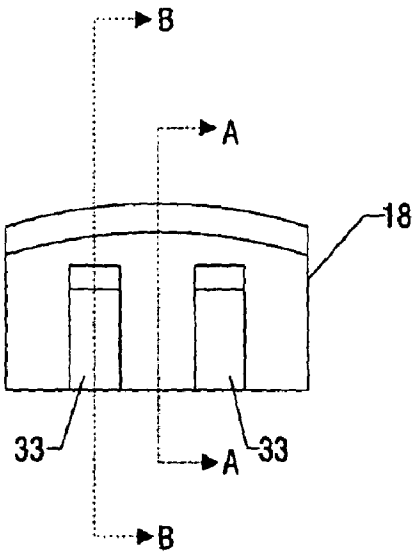
Figure 21D:
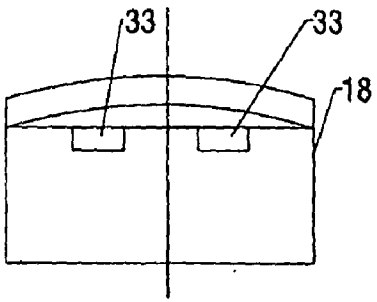

Referring to FIGS. 21A-21D, slip 18 is shown having two lateral cavities 33 in the shape of rectangular slots. FIG. 21A shows a side view of slip 18. FIG. 21B shows a cross section of slip 18. In this configuration, the outer wall of cavity 33 runs parallel to the center line shown in FIGS. 1-14; thus this cavity is a lateral cavity. Also, as best shown in FIGS. 21C and 21D, cavities 33 may be comprised of two slots having a rectangular cross section. However, as would be understood by one of ordinary skill in the art having the benefit of this disclosure, cavities 33 are not limited to being rectangular nor lateral. For instance, cavities 33 could have a square, trapezoidal, or circular cross-section. Cavities 33 could also reside as enclosed cubic, rectangular, circular, polygonal, or elliptical cavities within the slip 18. The cavities 33 could also be vertical, protruding through the wickered surface of the slip 18, or through the interior ramp 34 (discussed hereinafter), or through both. Further, the cavities 33 need not be lateral; the angle of the cavities in the form of slots could be at any angle. For instance, the outer wall of cavity 33 may run perpendicular to the center line shown in FIGS. 1-14, and thus be a vertical cavity. Further, the cavities 33 in the form of slots do not need to be straight, and could therefore be curved or run in a series of directions other than straight. All cavities 33 need not run in the same direction, either. For example, cavities 33 in the shape of slots could run from side-to-side of the slip 18, or at some angle to the longitudinal axis. If the cavities 33 are in the form of enclosed voids as described above, all cavities 33 are not required to be of the same geometry. Any known pattern or in random arrangement may be utilized.

Although two cavities 33 are shown in slip 18 in FIGS. 21A-D, any number of cavities 33 may be utilized.

Cavities 33 are sized to enhance break up of the slip 18 during the drilling out operation. As is known to one of ordinary skill in the art having the benefit of this disclosure, when slip 18 is being drilled, the cavities 33 allow for the slip 18 to break into smaller pieces compared to slips without cavities. Further, enough solid material is left within the slip so as to not compromise the strength of the slip 18 while it is carrying loads.

Also shown in FIG. 21B is the interior ramp 34 of the slip 18 that also enhances plug performance under conditions of temperature and differential pressure. Because it is designed to withstand compressive loads between the slip 18 and the weaker composite material of the cone 26 (mating part not shown, but described above) in service, the weaker composite material cannot extrude into cavities 33 of the slip 18. If this were to occur, the cone would allow the packing element system, against which it bears on its opposite end, to relax. When the packing element system relaxes, its internal rubber pressure is reduced and it leaks.

It should also be mentioned that previous the discussion and illustrations of FIGS. 21A-D pertaining to slips 18 are equally applicable to slips 58 as well.

Figure 22:
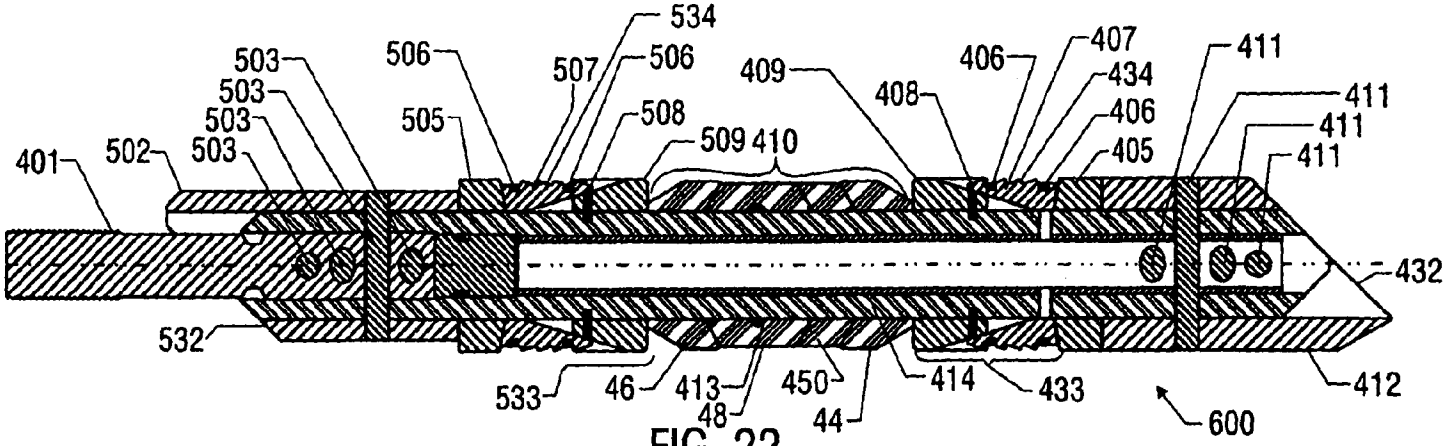
FIG. 22 shows a simplified view of a subterranean apparatus according to one embodiment of the present invention.

Referring to FIG. 22, another embodiment of the present invention is shown as a subterranean Bridge Plug assembly. Bridge Plug assembly 600 includes a mandrel 414 that may be constructed of metallic or non-metallic materials. The non-metallic materials may be a composite, for example a carbon fiber reinforced material, plastic, or other material that has high strength yet is easily drillable. Carbon fiber materials for construction of mandrel 414 may be obtained from ADC Corporation and others, for example XC-2 carbon fiber available from EGC Corporation. Metallic forms of mandrel 414—and mandrels 4 described previously and shown in FIGS. 1-20—include, but are not limited to, brass, copper, cast iron, aluminum, or magnesium. Further, these metallic mandrels may be circumscribed by thermoplastic tape, such as 0.5-inch carbon fiber reinforced PPS tape QLC4160 supplied by Quadrax Corp. of Portsmouth, R.I., having 60% carbon fiber and 40% PPS resin, or 68% carbon reinforced PEEK resin, model A54C/APC-2A from Cytec Engineered Materials of West Paterson, N.J. or they may be circumscribed by G-10 laminated epoxy and glass cloth or other phenolic material. Alternatively, mandrels 414 and 4 may be constructed utilizing in-situ thermoplastic tape placement technology, in which thermoplastic composite tape is continuously wound over a metal inner core. The tape is then hardened by applying heat using equipment such as a torch. A compaction roller may then follow. The metal inner core may then be removed thus leaving a composite mandrel.

Mandrel 414 may have a non-circular cross-section as previously discussed with respect to FIGS. 2 and 14-17, including but not limited to a hexagon, an ellipse, a triangle, a spline, a square, or an octagon. Any polygonal, elliptical, spline, or other non-circular shape is contemplated by the present invention.

Mandrel 414 is the general support for each of the other components of Bridge Plug assembly 600. The non-circular cross-section exhibited by mandrel 414 advantageously facilitates a rotational lock between the mandrel and all of the other components (discussed below). That is, if and when it becomes necessary to drill out bridge plug assembly 600, mandrel 414 is precluded from rotating with the drill: the non-circular cross-section of mandrel 414 prevents rotation of the mandrel 414 with respect to the other components which have surfaces interfering with the cross-section of the mandrel.

Attached to the lower end (the end on the right-hand side of FIG. 22) of mandrel 414 is a lower end cap 412. Lower end cap 412 may be constructed from a non-metallic composite that is easily drillable, for example an injection molded phenolic, or molded carbon-reinforced PEEK, or other similar materials, or may be metallic in some embodiments. Lower end cap 412 may be attached to mandrel 414 by a plurality of pins 411, and/or attached via an adhesive, for example. Pins 411 are arranged in different planes to distribute any shear forces transmitted thereto and may be any metallic material, or may be non-metallic composite that is easily drillable, for example an injection molded phenolic, or molded carbon-reinforced PEEK, or other similar materials. Lower end cap 412 prevents any of the other plug components (discussed below) from sliding off the lower end of mandrel 414. Lower end cap 412 may include a locking mechanism, for example tapered surface 432, that rotationally locks Bridge Plug assembly 600 with another abutting plug assembly (not shown) without the need for a third component such as a key. This rotational lock facilitates the drilling out of more than one plug assembly when a series of plugs has been set in a wellbore. For example, if two bridge plug assemblies 600 are disposed in a wellbore at some distance apart, then as the proximal plug is drilled out, any remaining portion of the plug will fall onto the distal plug, and lower end cap 412 will rotationally lock with the second plug to facilitate drilling out the remainder of the first plug before reaching the second plug.

In the embodiment shown in the figures, lower end cap 412 exhibits an internal surface matching the non-circular cross-section of mandrel 414 which creates a rotational lock between the end cap and mandrel; however, the internal surface of the lower end cap 412 may be any non-circular surface that precludes rotation between the end cap and mandrel 414. For example, the internal surface of lower end cap 412 may be square, while mandrel 414 has an outer surface that is hexagonal or octagonal, but rotation between the two is still advantageously precluded without the need for a third component such as a key.

Lower end cap 412 abuts an anchoring assembly 433. Anchoring assembly 433 includes a plurality of first slips 407 arranged about the outer diameter of mandrel 414. First slips 407 are arranged in a ring as shown in FIG. 3 with the slips being attached to one another by slip rings 406. As discussed in greater detail above with respect to FIG. 3, first slips 407 may be arranged in any configuration matching the cross-section of mandrel 414, which advantageously creates a rotational lock such that first slips 407 are precluded from rotating with respect to mandrel 414. In addition, the number of slips may be varied and the shape of slip ring may be such that rotation would be allowed between the slips and the mandrel—but for the channels 99 (discussed above with respect to FIG. 3). Further, the configuration of slip ring 406 may be any non-circular shape that precludes rotation between first slips 407 and mandrel 414. For example, the slip ring 406 may be square, while mandrel 414 has an outer surface that is hexagonal or octagonal, but rotation between the two is still precluded.

Each of first slips 407 may be constructed of non-metallic composite materials such as injection molded phenolic or may be metal such as cast iron. Also, each slip may includes a metallic inserts disposed in outer surface (not shown in FIG. 22, but shown as inserts 22 in FIG. 1). These metallic inserts are identical to those discussed above with respect to FIG. 1. Alternative, each of first slips 407 may be molded to have rough or wickered outer edges 434 to engage the wellbore. The first slips 407 of this embodiment may further include at least one cavity as discussed above with respect to FIGS. 21A-21D.

Anchoring assembly 433 also includes a first cone 409 arranged adjacent to the first plurality of slips 407. A portion of first slips 407 rest on first cone 409 as shown in FIG. 22. First cone 409 may be comprised of non-metallic composite materials such as phenolics, plastics, or continuous wound carbon fiber that are easily drillable, for example. First cone 409 may also be comprised of metallic materials such as cast iron.

Although not shown in this embodiment, first cone 409 may include a plurality of metallic inserts disposed in an inner surface adjacent mandrel 414, identical to the metallic inserts 28 of cones 26 shown and described in detail with respect to FIG. 1. In the running position, there is a gap (not shown in FIG. 22, but shown in FIG. 1) between the metallic inserts and mandrel 414. Metallic inserts 28 (of FIG. 1) may each have a wicker design as shown in the figures to facilitate a locked engagement with mandrel upon collapse of the cone. Metallic inserts 28 may be molded into the first cone 409 such that the first cone 409 and metallic inserts 28 comprise a single piece (as shown with respect to first cone 26 in FIG. 1); however, as shown in the embodiment shown in FIGS. 11-13, metallic inserts 28 may also be mechanically attached to first cone 26 by a fastener, for example screws 27. Metallic inserts 28 may be constructed of metallic materials such as cast iron, which may be heat treated to facilitate surface hardening sufficient to penetrate mandrel 414, while maintaining small, brittle portions such that the inserts do not hinder drilling operations. For example, metallic inserts 28 may be surface or through hardened to approximately plus or minus fifty-five Rockwell C hardness. Metallic inserts 28 may be integrally formed with first cone 409, for example, by injection molding the composite material that comprises first cone 409 around metallic inserts 28 as shown in FIG. 1; however, as shown in the embodiment shown in FIGS. 11-13, metallic inserts 28 may also be mechanically attached to first cone 26 by a fastener, for example screws 27.

The inner surface of first cone 409 may match the cross-section of mandrel 414 such that there is an advantageous rotational lock therebetween. As discussed above, the inner surface of cone 409 may be shaped hexagonally to match the cross-section of mandrel 414; however, it would be understood by one of ordinary skill in the art with the benefit of this disclosure that the inner surface of cone 409 may be arranged in any configuration matching the cross-section of mandrel 414. The complementary matching surfaces of the inner surface of cone 409 and the mandrel 414 cross-section creates a rotational lock such that mandrel 414 is precluded from rotating with respect to cone 409. In addition, however, the inner surface of the cone 409 may not match and instead may be any non-circular surface that precludes rotation between the cone and mandrel 414. For example, the inner surface of cone 409 may be square, while mandrel 414 has an outer surface that is hexagonal or octagonal, but rotation between the two is still advantageously precluded without the need for a third component such as a key.

First cone 409 may include a plurality of slots disposed therein which weaken first cone 409 at a predetermined force identical to those shown in FIG. 4 and described above. In some embodiments, when first cone 409 collapses, the remaining debris of the first cone tightly surround the mandrel 414 to preclude movement between anchoring assembly 433 and mandrel 414. In other embodiments, when first cone 409 collapses, metallic inserts 28 (not shown in this embodiment) penetrate mandrel 414 and preclude movement between anchoring assembly 433 and mandrel 414. One or more shearing devices, for example shear pins 408, may extend between first cone 409 and mandrel 414. Shear pins 408 preclude the premature setting of anchoring assembly 433 in the wellbore during run-in. Shear pins 408 may be designed to shear at a predetermined force. For example, shear pins 408 may shear at a force of approximately 1500 pounds; however, shear pins 408 may be designed to shear at any other desirable force. As shear pins 408 shear, further increases in force on first cone 409 will cause relative movement between first cone 409 and first slips 407. As discussed above with respect to FIG. 6, the relative movement between lower cone 409 and first slips 407 causes first slips 407 to move in a radially outward direction and into engagement with the casing wall. At some point of the travel of first slips 407 along first cone 409, slip ring 406 will break to allow each of first slips 407 to engage the casing wall. For example, slip ring 406 may break between 1500 and 3000 pounds, with slips 407 being fully engaged with the casing wall at 3000 pounds (similar to that shown in FIGS. 6 and 12.).

First cone 409 abuts a push ring 405 in some embodiments. Push ring 405 may be non-metallic, comprised, for example, of molded phenolic or molded carbon reinforced PEEK. Push ring 405 includes a non-circular inner surface that precludes rotation between the push ring 405 and mandrel 414. For example the inner surface of push ring 405 may be hexagonal, matching a hexagonal outer surface of mandrel 414. But the inner surface of push ring 405 is not limited to a match as long as the shape precludes rotation between the gage ring and the mandrel.

Packing element 410 may include three or four independent pieces. Packing element 410 may include first and second end elements 44 and 46 with an elastomeric portion 48 disposed therebetween. In the embodiments shown in FIG. 22, packing element 410 further includes booster ring 450 disposed between elastomeric portion 48 and first end element 44. Booster ring 450 may be utilized in high pressure applications to prevent leakage. Booster ring 450 acts to support elastomeric portion 48 of packing element 410 against mandrel 414 in high pressure situations. As described herein, the packing element 410 has a non-constant cross sectional area. During operation, when buckling the packing element 410, the packing element 410 is subject to uneven stresses. Because the booster ring 450 has a smaller mass than the packing element 410, the booster ring 450 will move away from the mandrel 414 before the packing element 410; thus the booster ring 450 will contact the casing prior to the packing element 410 contacting the casing. This action wedges the packing element tightly against the casing, thus closing any potential leak path caused by the non-constant cross section of the packing element 410. The packing element 410 may also include a lip (not shown) to which the booster ring 450 abuts in operation.

Booster ring 450 includes a non-circular inner surface that may match the cross-section of mandrel 414, for example, hexagonal. The match between the non-circular surface of booster ring 450 and the cross-section of mandrel 414 advantageously precludes rotation between the packing element and the mandrel as shown in any of FIGS. 14-17. However, the non-circular surface of booster ring 450 may be any non-circular surface that precludes rotation between the booster ring 450 and mandrel 414. For example, the surface of the booster ring 450 may be hexagonal, while mandrel 414 has an outer surface that is octagonal, but rotation between the two is still precluded.

Elastomeric portion 48 of packing element 410 comprises a radial groove to accommodate an O-ring 413 which surrounds mandrel 414. O-ring 413 assists in securing elastomeric portion 48 at a desired location on mandrel 414. First and second end elements 44 and 46 may include a wire mesh encapsulated in rubber or other elastomeric material. Packing element 410 includes a non-circular inner surface that may match the cross-section of mandrel 414, for example, hexagonal. The match between the non-circular surface of packing element 410 and the cross-section of mandrel 414 advantageously precludes rotation between the packing element and the mandrel as shown in any of FIGS. 14-17. However, the non-circular surface of packing element 410 may be any non-circular surface that precludes rotation between the packing element and mandrel 414. For example, the surface of packing element 410 may be hexagonal, while mandrel 414 has an outer surface that is octagonal, but rotation between the two is still precluded. Packing element 410 is predisposed to a radially outward position as force is transmitted to the end elements 44 and 46, urging elastomeric portion 48 of packing element 410 into a sealing engagement with the casing wall and the outer surface of mandrel 414. Elastomeric portion 48 of packing element 410 may seal against the casing wall at, for example, 5000 pounds.

End element 46 of packing element 410 abuts a second cone 509, which may be metallic or non-metallic. Second cone 509 may be comprised of metallic materials that are easily drillable, such as cast iron, or of non-metallic composite materials that are easily drillable such as phenolics, plastics, or continuous wound carbon fiber. Second cone 509 is a part of anchoring assembly 533. Second cone 509, similar to first cone 409, may include a non-circular inner surface matching the cross-section of mandrel 414. In the embodiment shown in the figures, the inner surface of second cone 509 is hexagonally shaped. The match between inner surface of second cone 509 precludes rotation between mandrel 414 and second cone 509. However, inner surface of second cone 509 may be any non-circular surface that precludes rotation between second cone 509 and mandrel 414. For example, inner surface of second cone 509 may be square, while mandrel 414 has an outer surface that is hexagonal or octagonal, but rotation between the two is still precluded. In one embodiment, second cone 509 does not include any longitudinal slots as first cone 409 does; however, in an alternative embodiment second cone 509 does include the same elements as first cone 409. Second cone 509 includes one or more shearing devices, for example shear pins 508, that prevent the premature setting of a second plurality of slips 507. Shear pins 508 may shear at, for example approximately 1500 pounds.

As discussed above with respect to the identical cones shown in FIG. 4, second cone 509 may include a plurality of channels formed therein. Each of channel is associated with its respective second slip 507. The channels (99 in FIG. 4) advantageously create a rotational lock between second slips 507 and second cone 509.

Anchoring assembly 533 further includes the second plurality of slips 507 arranged about the outer diameter of mandrel 414 in a fashion similar to that of the first plurality of slips 407. Second slips 507 (like slips 18 in FIG. 3) are arranged in a ring with the slips being attached to one another by slip ring 506. Similar to the embodiment shown in FIG. 3, there are six slips 507 arranged in a hexagonal configuration to match the cross-section of mandrel 414. It will be understood by one of skill in the art with the benefit of this disclosure that second slips 507 may be arranged in any configuration matching the cross-section of mandrel 414, which advantageously creates a rotational lock such that slips 507 are precluded from rotating with respect to mandrel 414. Further, the configuration of slip ring 506 may be any shape that precludes rotation between second slips 507 and mandrel 414. For example, the slip ring 506 may be square, while mandrel 414 has an outer surface that is hexagonal or octagonal, but rotation between the two is still precluded. In addition, the number of slips may be varied and the shape of slip ring may be such that rotation would be allowed between the slips and the mandrel—but for the channels.

Each of second slips 507 may be constructed of non-metallic composite materials such as injection molded phenolic or may be metal such as cast iron. Also, each second slip 507 may be molded or machined to have rough or wickered outer edges 534 to engage the wellbore. Each second slips 507 of this embodiment may further include at least one cavity as discussed above with respect to FIGS. 21A-21D. Further, each second slip 507 may include a metallic inserts disposed in outer surface (not shown in FIG. 22, but shown as inserts 22 in FIG. 1). The inserts method of attaching the inserts to second slips 507 in this embodiment is identical to that described for inserts 22 in FIG. 1.

Further, although not shown in this embodiment, first cone 409 may include a plurality of metallic inserts disposed in an inner surface adjacent mandrel 414, identical to the metallic inserts 28 of cones 26 shown and described in detail with respect to FIG. 1. In the running position, there is a gap (not shown in FIG. 22, but shown in FIG. 1) between metallic inserts 28 and mandrel 414. Metallic inserts 28 may each have a wicker design as shown in the figures to facilitate a locked engagement with mandrel upon collapse of the cone. Metallic inserts 28 may be molded into the first cone 409 such that the first cone 409 and metallic inserts 28 comprise a single piece (as shown with respect to first cone 26 in FIG. 1); however, as shown in the embodiment shown in FIGS. 11-13, metallic inserts 28 may also be mechanically attached to first cone 26 by a fastener, for example screws 27. Metallic inserts 28 may be constructed of low density metallic materials such as cast iron, which may be heat treated to facilitate surface hardening sufficient to penetrate mandrel 414, while maintaining small, brittle portions such that the inserts do not hinder drilling operations. For example, metallic inserts 28 may be surface or through hardened to approximately plus or minus fifty-five Rockwell C hardness. Metallic inserts 28 may be integrally formed with second cone 509, for example, by injection molding the composite material that comprises second cone 509 around metallic inserts 28 as shown in FIG. 1; however, as shown in the embodiment shown in FIGS. 11-13, metallic inserts 28 may also be mechanically attached to second cone 509 by a fastener, for example screws 27.

Adjacent second slips 507 is a second push ring 505. Push ring 505 may be metallic, such as cast iron, or non-metallic, e.g. molded plastic, phenolic, or molded carbon reinforced PEEK. Push ring 505 is a solid piece with an inner surface that may match the cross-section of mandrel 414. For example the inner surface of push ring 505 may be hexagonal. However, the inner surface of push ring 505 may be any surface that precludes rotation between push ring 505 and mandrel 414. For example, inner surface of push ring 505 may be square, while mandrel 414 has an outer surface that is hexagonal or octagonal, but rotation between the two is still precluded Push ring 505, like the other components mounted to mandrel 414, may have substantially circular outer diameter. The match between inner surface of push ring 505 and the cross-section of mandrel 414 advantageously precludes rotation between push ring 505 and mandrel 414.

Push ring 505 abuts a upper end cap 502. Upper end cap 502 may be any easily-drillable material, such as metallic material (cast iron) or non-metallic material (e.g. injection molded phenolic, plastic, molded carbon reinforced PEEK, or other similar material). Upper end cap 502 may be attached to mandrel 414 by a plurality of pins 503, and/or attached via an adhesive, for example. Pins 503 are arranged in different planes to distribute any shear forces transmitted thereto and may be any metallic material or non-metallic composite that is easily drillable, for example an injection molded phenolic, or molded carbon-reinforced PEEK, or other similar materials.

Upper end cap 502 prevents any of the other Bridge Plug components (discussed above) from sliding off the upper end of mandrel 414. In the embodiment shown in the figures, upper end cap 502 exhibits an internal surface matching the non-circular cross-section of mandrel 414 which creates a rotational lock between the end cap and mandrel; however, the internal surface of the upper end cap 502 may be any non-circular surface that precludes rotation between the end cap and mandrel 414. For example, the internal surface of upper end cap 502 may be square, while mandrel 414 has an outer surface that is hexagonal or octagonal, but rotation between the two is still precluded. The upper end of mandrel 414 may include a locking mechanism, for example tapered surface 532, that rotationally locks Bridge Plug assembly 600 with another abutting plug assembly (not shown). Tapered surface 532 is engageable with tapered surface 432 of lower end cap 412 such that rotation between two plugs is precluded when surfaces 532 and 432 are engaged.

Attached to the upper end of Bridge Plug 600 is release stud 401. Release stud 401 is attached to upper cap 502 via pins 503, previously described. Release stud is typically comprised of brass, although multiple commercially-available materials are available.

It will be understood by one of skill in the art with the benefit of this disclosure that one or more of the non-metallic components may include plastics that are reinforced with a variety of materials. For example, each of the non-metallic components may comprise reinforcement materials including, but not limited to, glass fibers, metallic powders, wood fibers, silica, and flour. However, the non-metallic components may also be of a non-reinforced recipe, for example, virgin PEEK, Ryton, or Teflon polymers. Further, in some embodiments, the non-metallic components may instead be metallic component to suit a particular application. In a metallic-component situation, the rotational lock between components and the mandrel remains as described above.

Operation and setting of Bridge Plug assembly 600 is as follows. Bridge Plug assembly 600, attached to the release stud 401 via pins 503, is lowered into a wellbore to the desired setting position. A setting sleeve (not shown) supplies a downhole force on upper push ring 505 to shear pins 508 of second cone 509. At a predetermined load, for example a load of approximately 1500 pounds, shear pins—shown as 508 on FIGS. 23-26—shear and the elastomeric portion 48 of packing element 410 begins its radial outward movement into sealing engagement with the casing wall. As the setting force from the setting sleeve (not shown) increases and the elastomeric portion 48 of packing element 410 is compressed, the slip rings 506 break and the second plurality of slips 507 traverse second cone 509. Eventually each of second plurality of slips 507 continue to traverse second cone 509 until the wickered edges 534 (or metallic inserts, if used) of each slip penetrates the casing wall.

Similar to the operation of the second plurality of slips 507, the load transmitted by the setting sleeve also causes shear pins 408 between first cone 409 and mandrel 414 to shear at, for example, approximately 1500 pounds, and allow first plurality of slips 407 to traverse first cone 409. First plurality of slips 407 traverse first cone 409 and eventually first ring 406 breaks and each of first plurality of slips 407 continue to traverse first cone 409 until wickered surface 434 (or metallic inserts if used) of each slip penetrates the casing wall. Force supplied through the setting sleeve (not shown) continues and at, for example, approximately 3000 pounds of force, first and second pluralities of slips 407 and 507 are set in the casing wall.

In some embodiments, as the force transmitted by the setting sleeve continues to increase, eventually first cone 409 and second cone 509 may deflect around mandrel 414. In other embodiments metallic cone inserts on first cone 409 and second cone 509 grip the mandrel 414 at this point. In yet other embodiments, the remaining fragments of broken first cone 409 and second cone 509 collapse on the mandrel 414. First cone 409 and second cone 509 may deflect, for example, at approximately 4500 pounds. As first cone 409 and second cone 509 deflect around mandrel 414, mandrel 414 is locked in place with respect to the outer components. Force may continue to increase via the setting sleeve to further compress packing element 410 into a sure seal with the casing wall. Packing element 410 may be completely set at, for example approximately 25,000 pounds.

In some embodiments, as the force transmitted to the setting sleeve continues to increase, eventually release stud 401 fractures, typically at the point 402 having the smallest diameter.

Because Bridge Plug assembly 600 may include non-metallic components, Bridge Plug assembly 600 may be easily drilled or milled out as desired with only a coiled tubing drill bit and motor with a mill, for example. In addition, as described above, all components are rotationally locked with respect to mandrel 414, further enabling quick drill-out. Tapered surface 432 of first end cap 412 also rotationally locks with tapered surface 532 of upper end cap 502 such that multiple plug drill outs are also advantageously facilitated by the described apparatus.

Figure 23:
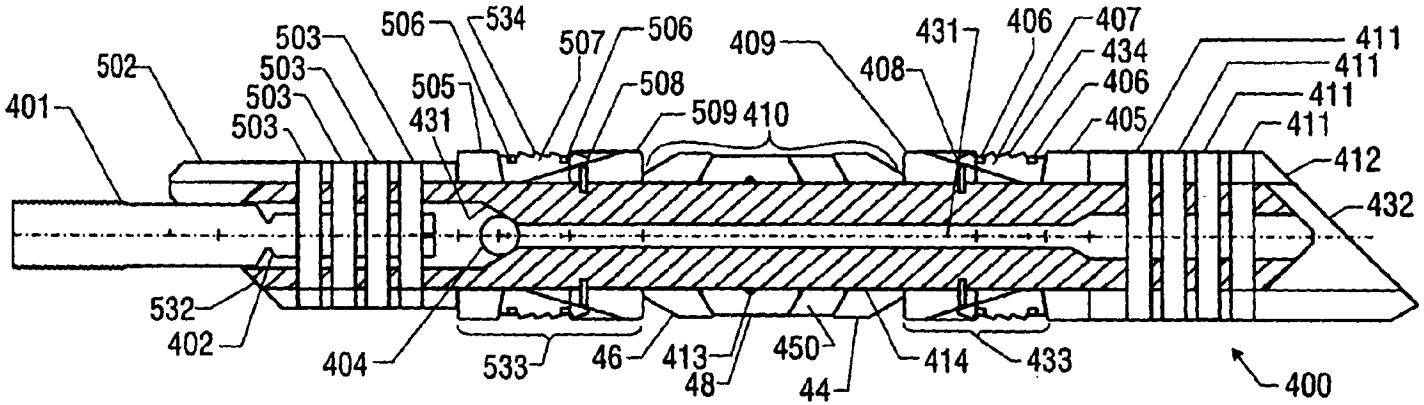
FIG. 23 is a simplified view of a subterranean apparatus and adapter kit assembly according to one embodiment of the present invention.
Figure 24:
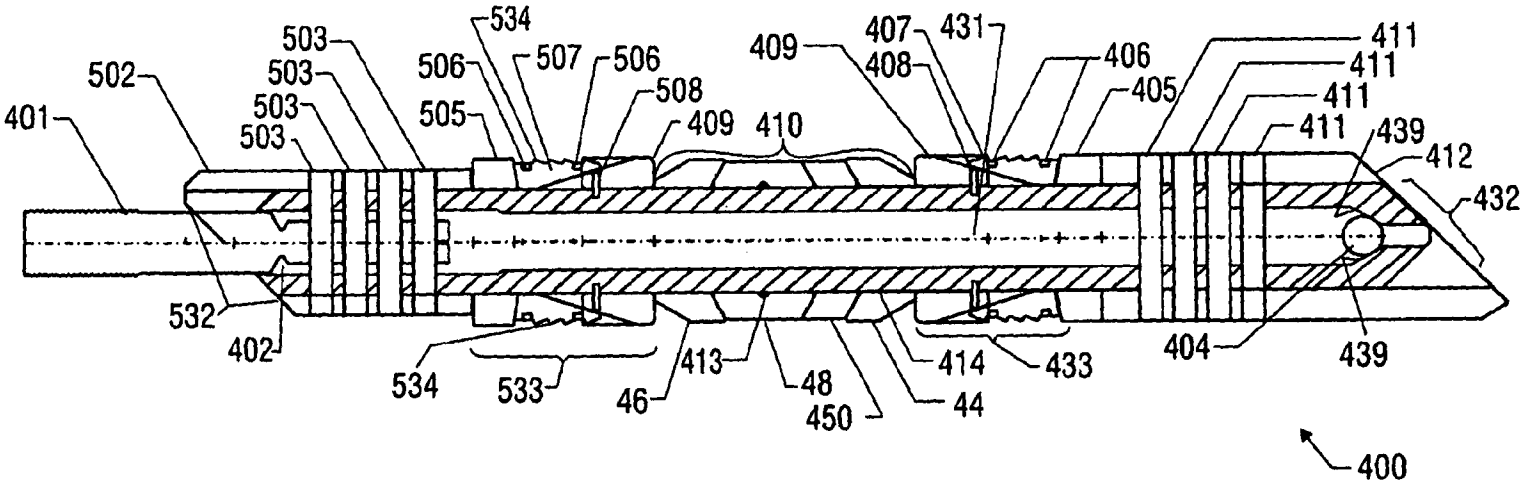
FIG. 24 shows a simplified view of a subterranean apparatus and adapter kit assembly according to one embodiment of the present invention.

Referring to FIGS. 23 and 24, another embodiment of the present invention is shown as a subterranean Frac Plug assembly 400. Construction and operation of the embodiment shown in FIG. 23 is identical to those of the embodiment of FIG. 22 with the exception of the valve system as described below.

In the Frac Plug assembly 400 shown in FIGS. 23 and 24, mandrel 414 includes a cylindrical hole 431 therethrough. As shown, cylindrical hole 431 through mandrel 414 is not of uniform diameter: at a given point, the diameter of hole 431 gradually narrows thus creating ball seat 439. Ball seat 439 may be located toward the upper end of the mandrel 414 as shown in FIG. 23, or on the lower end of the mandrel 414 as shown in FIG. 24. Resting within ball seat 431 is ball 404. The combination of the ball 404 resting in ball seat 431 results in the mandrel 414 having an internal ball valve that controls the flow of fluid through Frac Plug assembly 400. As would be appreciated by one of ordinary skill in the art having the benefit of this disclosure, the ball allows fluid to move from one direction and will stop fluid movement from the opposite direction. For instance, in the configurations shown in FIGS. 23 and 24, fluid may pass from right (lower end) to left (upper end) thus allowing fluid to escape from the reservoir to the earth's surface. Yet fluids are prevented from entering the reservoir. The ball valve comprised of ball 404 and ball seat 431 disclosed in FIGS. 23 and 24 are exemplary assemblies, but other valving assemblies are also contemplated by the present invention.

This through-hole and valve arrangement facilitates the flow of cement, gases, slurries, oil, or other fluids through mandrel 414. One of skill in the art with the benefit of this disclosure will recognize this feature to allow the Frac Plug assembly 400 to be used for multiple purposes.

The composition, operation, and setting of the remaining components of this Frac Plug 400 embodiment of the present invention is identical to that of the Bridge Plug of FIG. 22 discussed above.

Figure 25:
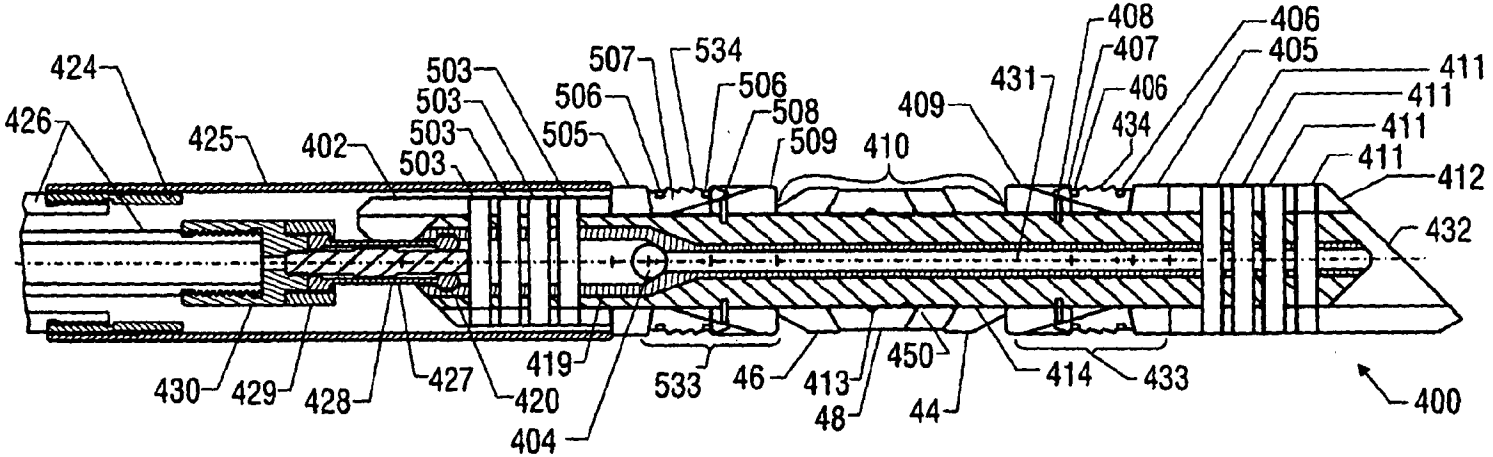
FIG. 25 is a simplified view of a subterranean apparatus and adapter kit assembly according to one embodiment of the present invention.

Referring to FIG. 25, the Frac Plug assembly 400 of FIGS. 23 and 24 is shown including a wire line adapter kit. Construction and operation of the embodiment shown in FIG. 25 is identical to those of the embodiment of FIG. 23 with the exception of the wire line adapter kit. The wire line adapter kit is comprised of a collet 427, a rod 428, a shear ring 429, a crossover 430, an adapter bushing 424, and a setting sleeve 425. It will be understood by one of ordinary skill in the art that the following wire line adapter kits may be utilized with any number of subterranean devices, including the Bridge Plug of FIG. 23.

Mandrel 414 in the embodiment shown in FIG. 25 is comprised of continuous carbon fiber wound over a metallic sleeve 419 as described above. In this embodiment, the upper end of mandrel 414 includes grooves 420 extending around mandrel 414. Grooves 420 are receptive of a collet 427. Collet 427 is part of a wire line adapter kit. Wire line adapter kit includes an adapter bushing 424 receptive of a setting tool 426. Adapter bushing 424 is receptive, for example of a Baker E-4 wireline pressure setting assembly (not shown), but other setting tools available from Owen, H.I.P., and Schlumberger may be used as well. The setting tools include, but are not limited to: wireline pressure setting tools, mechanical setting tools, and hydraulic setting tools. Adjacent adapter bushing 424 is a setting sleeve 425. Setting sleeve 425 extends between the setting tool 426 and frac plug 400 or other subterranean device via adapter. A distal end of setting sleeve 425 abuts push ring 505. The setting tool 426 also connects to the wire line adapter kit at crossover 430. Crossover 430 is part of the wire line adapter kit. Setting sleeve 425 and crossover 430 facilitate the application of forces on Frac Plug 400 in opposite directions. For example setting sleeve 425 may transmit a downward force (to the right as shown in the figures) on Frac Plug 400, while crossover 430 transmits an upward force (to the left as shown in the figures). The opposing forces enable compression of packing element 48 and anchoring assemblies 433 and 533. Rigidly attached to crossover 430 is a sheer ring 429. Collet 427 may be shearably connected to crossover 430, for example by shear ring 429 or other shearing device such as shear pins (not shown). Collet 427 surrounds rod 428. Rod 428 is also rigidly attached to crossover 430 at its proximal end. The distal end of collet 427 engages grooves 420 of composite mandrel 414.

Returning to the operation of the Frac Plug assembly, once the Frac Plug is set, the crossover 430 begins to try to move uphole via a force supplied by the setting tool 426. Collet 427 is connected to mandrel 414 via grooves 420. The uphole force is transmitted via crossover 430 to shear ring 429, which may shear at, for example 30,000 pounds. As shear ring 429 shears, crossover 430 moves uphole and setting sleeve 425 moves downhole.

As crossover 430 and support sleeve 425 move in opposite directions, any small applied force will snap collet 427 out of grooves 420 in mandrel 414, and the wire line adapter kit can be retrieved to surface via its attachment to the setting tool 426. In this way, the entire wire line adapter kit is removed from the casing. Therefore, no metal is left down hole. This is advantageous over prior art methods which leave some metal downhole, as any metal left downhole increases the time to drill or mill out the downhole component. Additionally, it has been found that this wire line adapter kit is less expensive to manufacture than prior art units, based on its relatively simple design.

Figure 26:
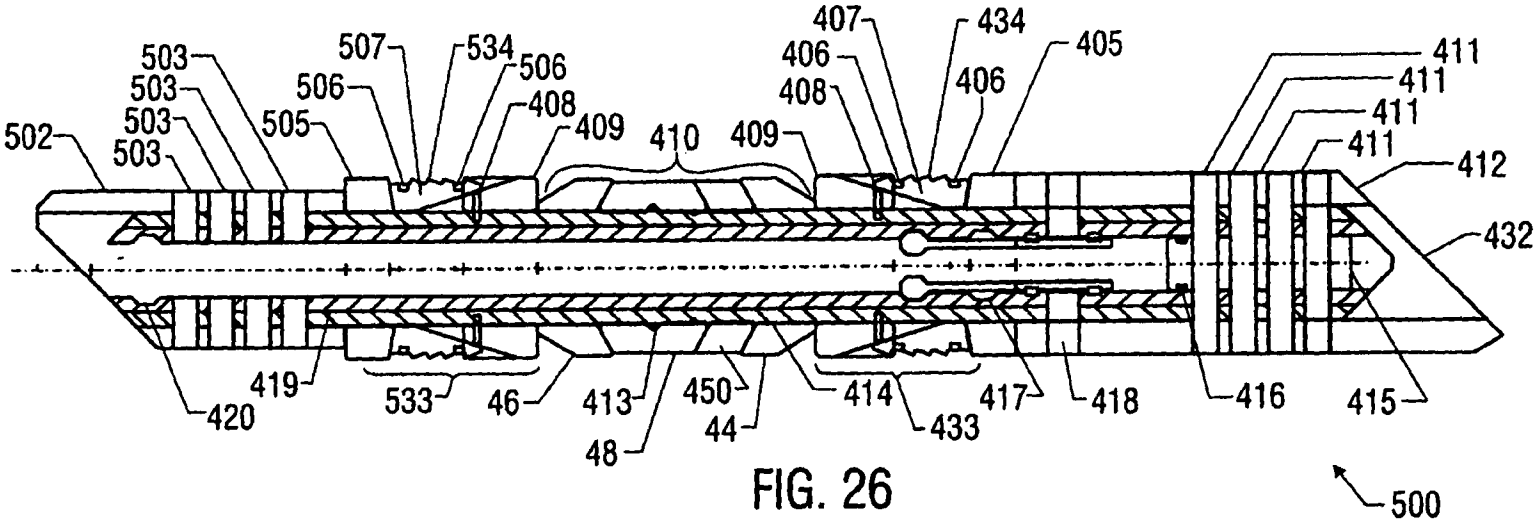
FIG. 26 shows simplified view of a subterranean apparatus and adapter kit assembly according to one embodiment of the present invention.

Referring to FIG. 26, another embodiment of the present invention is shown as a composite cement retainer 500. In this embodiment, mandrel 414 is comprised of continuous carbon fiber wound over a metallic sleeve 419. The metallic sleeve has at least one groove 420 on its distal end for attaching a wire line adapter kit (not shown, but described above with respect to the embodiment shown in FIG. 25). In this embodiment, radial holes are drilled in the proximal end of mandrel 414 creating vents 418.

The composite cement retainer 500 of this embodiment comprises the same features as the Frac Plug assembly 400 of FIGS. 23 and 24. Construction and operation of the embodiment shown in FIG. 26 is identical to that of the embodiment of FIG. 25 with the exception of plug 415, O-ring 416, collet 417, and vents 418 in mandrel 414. In the configuration shown in FIG. 26, vents 418 are in a closed position, i.e., collet 417 acts as a barrier to prevent fluids from moving from inside the mandrel 414 to the outside of the mandrel and vice versa.

Once the cement retainer is set—using the identical operation as setting the Frac Plug 400 previous embodiments—a shifting tool (not shown) may be inserted into the hollow mandrel 414 to grasp collet 417. The shifting tool may then be moved downwardly to shift collet 417 within the mandrel 414. Once collet 417 is shifted down in mandrel 414, fluid communication is possible from the inside to the outside of the mandrel 414 and next to encase the wellbore. Thus, cement slurry may be circulated by pumping cement inside the hollow mandrel 414 at its upper end. The cement travels down the mandrel until the cement contacts plug 415 prevents the cement from continuing downhole. O-ring 416 seals plug 415 within the mandrel 414. The cement slurry therefore travels through vents 418 in mandrel 414 and out of the cement retainer 500.

Figure 27:
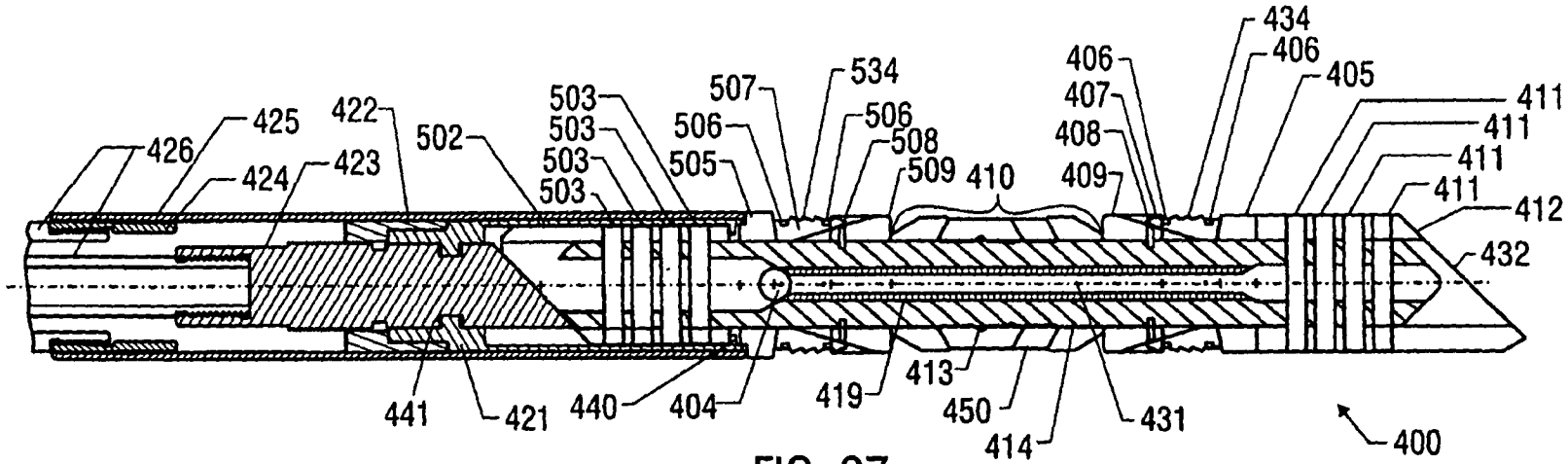
FIG. 27 is a simplified view of a subterranean apparatus and adapter kit assembly according to one embodiment of the present invention.

Referring to FIG. 27, another embodiment of the present invention is shown. In this embodiment, composite Frac Plug 400 is identical to that disclosed with respect to FIG. 25 with the exception of the wire line adapter kit. In this embodiment, the wire line adapter kit comprises an adapter bushing 424, shear sleeve 421 having a flange 441 and tips 440, a retainer 422, a body 423, and a setting sleeve 425. Shear sleeve 42 is connected to body 423 by retainer 422. Tips 440 secure the wire line adapter kit to upper end cap 502 of the subterranean device.

Once the packing element 410 has been set, body 423 begins to try to move uphole until the tips 440 of shear sleeve 421 shear, which may shear at, for example 30,000 pounds. As tips 440 of shear sleeve 421 shear, body 423 and retainer 422 move uphole. Body 423, retainer 422, adapter bushing 424, shear sleeve 421, and setting sleeve 425 of the wire line adapter kit move uphole and can be retrieved to the surface via attachment to the setting tool 426. Because only the tips 440 of the shear sleeve remain in the downhole device, less metal is left in the casing than when using known wire line adapter kits. When the downhole component is subsequently milled out, the milling process is not hampered by excessive metal remaining in the downhole device from the wire line adapter kit, as is the problem in the prior art.

While the embodiments shown in FIGS. 25-27 show the wire line adapter kits attached to the frac plug of FIGS. 23 and 24, these embodiments are not so limited. For instance, the same wire line adapter kits of FIGS. 25-27 may be utilized with any number of subterranean apparatus, such as the drillable bridge plug of FIG. 22, for instance.

Figure 28:
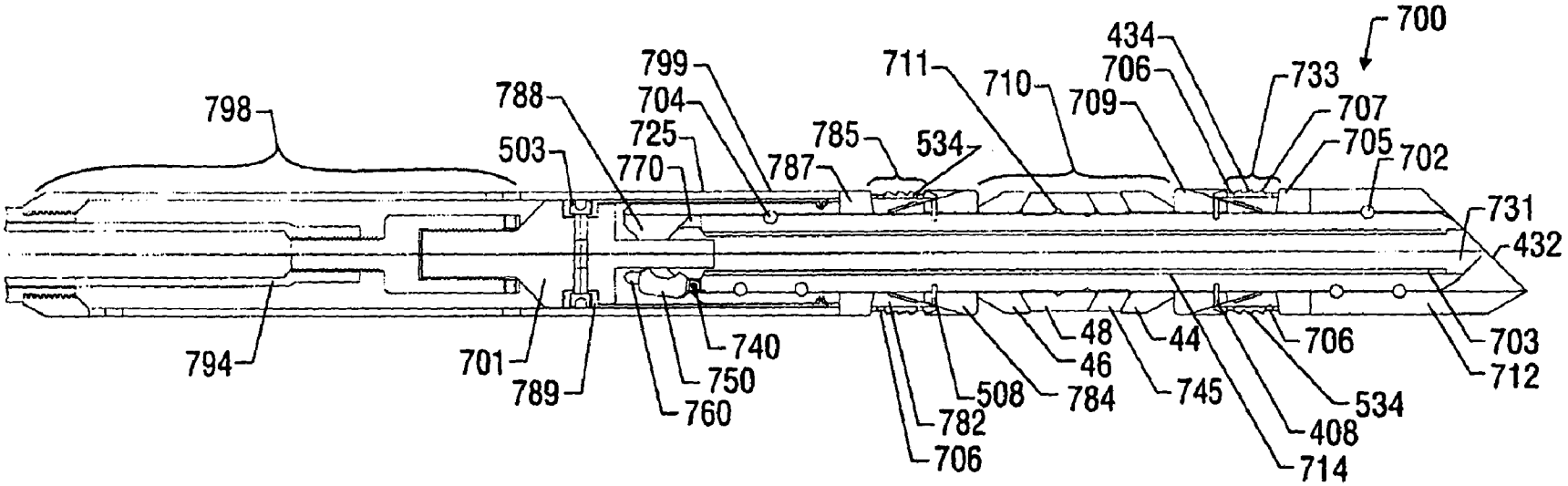
FIG. 28 shows an embodiment of a downhole tool such as Frac Plug assembly 700 of one embodiment of the present invention being run in hole.
Figure 29A:
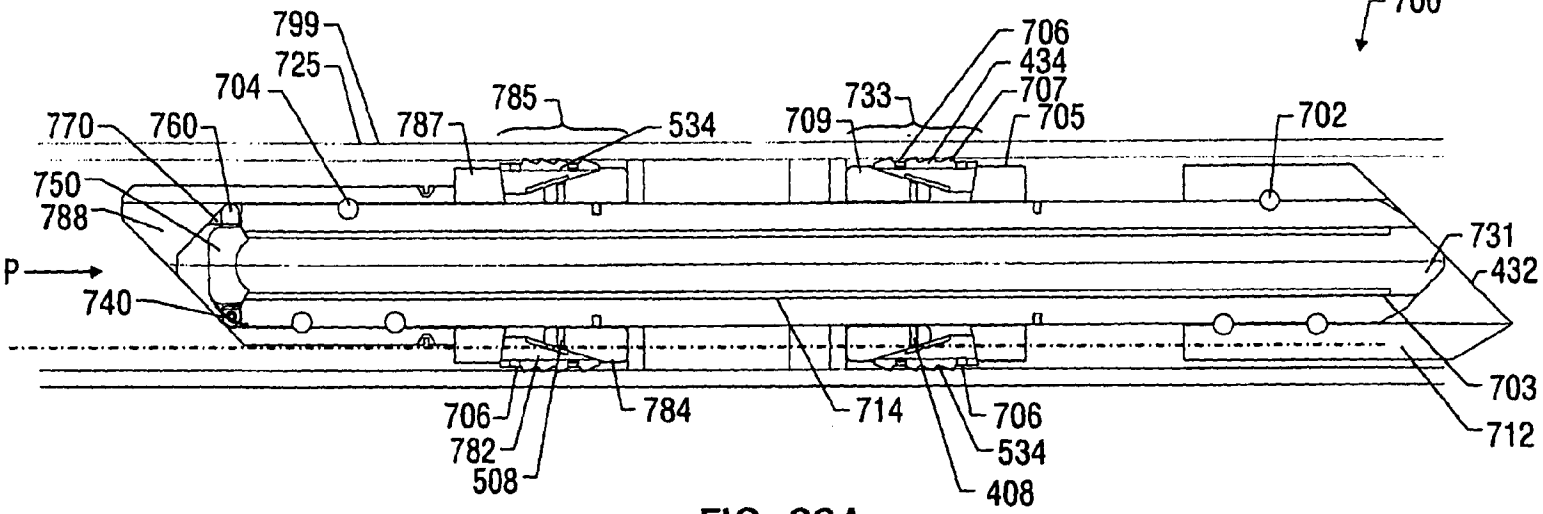
FIG. 29A shows the Frac Plug assembly 700 of FIG. 28 having a valve in the closed position, the valve having a tab.
Figure 29D:
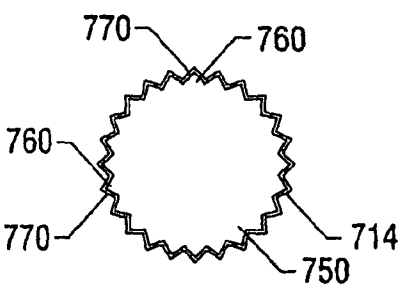
FIG. 29D shows a valve of Frac Plug assembly 700 of FIG. 28 having a plurality of tabs mating with a plurality of recesses in the mandrel.
Figure 29C:
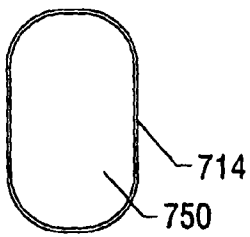
FIG. 29C shows a valve of Frac Plug assembly 700 of FIG. 28 having a valve in the closed position, the valve having a non-circular cross section mating with a mandrel having a non-circular cross section.
Figure 29B:
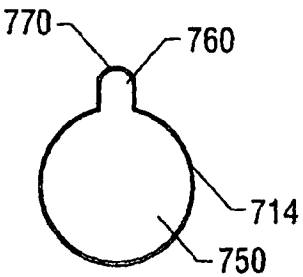
FIG. 29B shows the valve of Frac Plug assembly 700 of FIG. 28, the valve having a tab mating with a recesses in the mandrel.
Figure 30:
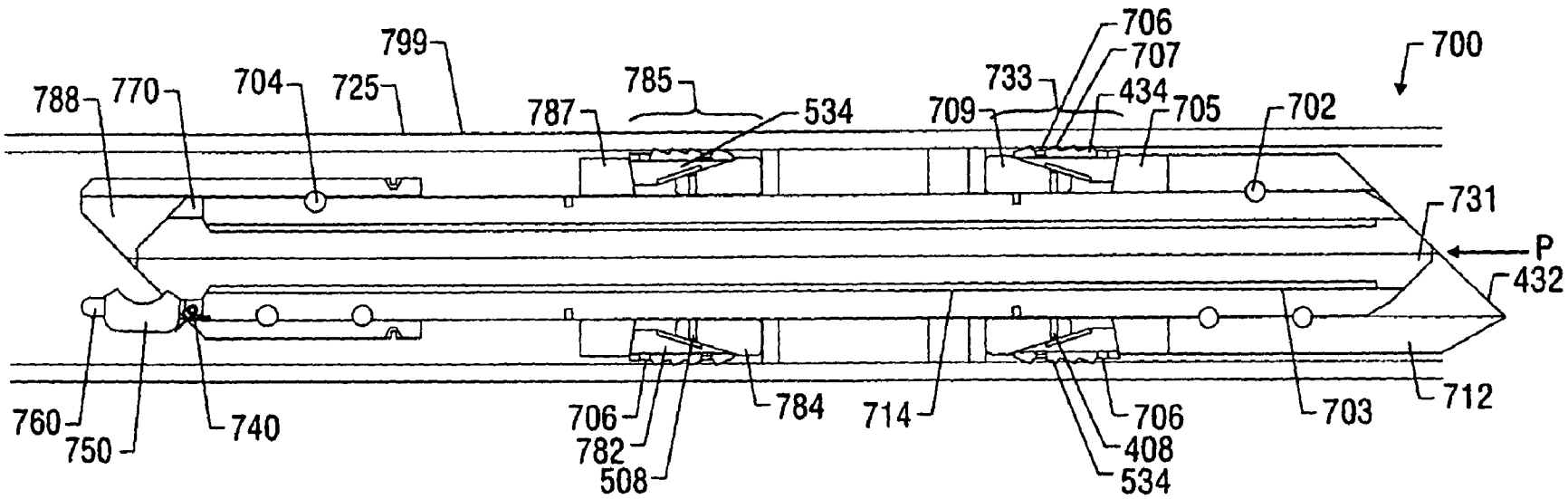
FIG. 30 shows the Frac Plug assembly 700 of FIG. 28 having a valve in the open position.

Referring to FIGS. 28-30, another embodiment of a downhole tool of the present invention, shown as a subterranean Frac Plug assembly 700. The composition, operation, and setting of some of the components of the Frac Plug 700 may be similar to that of the Bridge Plug 600 of FIG. 22 and the Frac Plug 400 of FIGS. 23 and 24 described above. In FIG. 28, the Frac Plug assembly 700 is shown assembled to a Wireline Adapter kit 798. Frac Plug assembly 700 includes a mandrel 714 that may be constructed of metallic or non-metallic materials as described above with respect to mandrels 4 and 414. Further, mandrel 714 may be circumscribed by tape, as described above.

Mandrel 714 may have a circular cross-section in this embodiment. However, while not necessary in this embodiment, mandrel 714 may have a non-circular cross-section as previously discussed with respect to FIGS. 2, 14-17, and 22, including but not limited to a hexagon, an ellipse, a triangle, a spline, a square, or an octagon. Any polygonal, elliptical, spline, or other non-circular shape is contemplated by the present invention.

Mandrel 714 is the general support for each of the other components of Frac Plug assembly 700. If the mandrel 714 has a non-circular cross-section, the non-circular cross-section exhibited by mandrel 714 advantageously facilitates a rotational lock between the mandrel 714 and all of the other components (discussed below). That is, if and when it becomes necessary to remove Frac Plug assembly 700, e.g. by drilling or milling, mandrel 714 is precluded from rotating with the removal tool: the non-circular cross-section of mandrel 714 prevents rotation of the mandrel 714 with respect to the other components which have surfaces interfering with the cross-section of the mandrel.

Attached to the lower end (the end on the right-hand side of FIG. 28) of mandrel 714 is a lower end cap 712. Lower end cap 712 may be constructed from a non-metallic composite that is easily removable, for example an injection molded phenolic, or molded carbon-reinforced PEEK, or other similar materials, or may be metallic in some embodiments. Lower end cap 712 may be attached to mandrel 714 by a plurality of tangential pins 702, and/or attached via an adhesive, for example. Tangential pins 702 are arranged in different planes to distribute any shear forces transmitted thereto and may be any metallic material, or may be non-metallic composite that is easily removable, for example an injection molded phenolic, or molded carbon-reinforced PEEK, or other similar materials. Lower end cap 712 prevents any of the other plug components (discussed below) from sliding off the lower end of mandrel 714. Lower end cap 712 may include a locking mechanism, for example tapered surface 432, that rotationally locks Frac Plug assembly 700 with another abutting plug assembly (not shown) without the need for a third component such as a key. This rotational lock facilitates the removal of more than one assembly when a series of assemblies have been set in a wellbore, as described above.

Lower end cap 712 has an internal surface which matches the shape of the outer surface of the mandrel 714. As the mandrel 714 may or may not have a non-circular cross-section in this embodiment, the lower end cap 712 similarly may or may not have a non-circular cross section. In some embodiments, both are circular. In other embodiments, the internal surface of lower end cap 712 is non-circular to match a non-circular mandrel, which creates a rotational lock between the end cap 712 and mandrel 714. In these embodiments, the internal surface of the lower end cap 712 may be any non-circular surface that precludes rotation between the end cap and mandrel 714. For example, the internal surface of lower end cap 712 may be square, while mandrel 714 has an outer surface that is hexagonal or octagonal, but rotation between the two is still advantageously precluded without the need for a third component such as a key.

Lower end cap 712 abuts an anchoring assembly 733, or may abut a push ring 705 as discussed hereinafter. Anchoring assembly 733 includes a plurality of first slips 707 arranged about the outer diameter of mandrel 714. First slips 707 are arranged in a ring as shown in FIG. 3 with the slips being attached to one another by slip rings 706. As discussed in greater detail above with respect to FIG. 3, first slips 707 may be arranged in any configuration matching the cross-section of mandrel 714. In this embodiment, the slips 707 may be arranged in a circular fashion around a circular mandrel 714. Alternatively, the slips 707 may be arranged in a non-circular fashion around a non-circular mandrel 714, which advantageously creates a rotational lock such that first slips 707 are precluded from rotating with respect to mandrel 714. In addition, the number of slips may be varied and the shape of slip ring 706 may be such that rotation would be allowed between the slips and the mandrel—but for the channels 99 (discussed above with respect to FIG. 3). Further, the configuration of slip ring 706 may be circular, or may be any non-circular shape, and may preclude rotation between first slips 707 and mandrel 714. For example, the slip ring 706 may be square, while mandrel 714 has an outer surface that is hexagonal or octagonal, but rotation between the two is still precluded.

Each of first slips 707 may be constructed of non-metallic composite materials such as injection molded phenolic or may be metal such as cast iron. Also, each slip may includes a metallic inserts disposed in outer surface (shown as inserts 22 in FIG. 1). These metallic inserts are identical to those discussed above with respect to FIG. 1. Alternative, each of first slips 707 may be molded to have rough or wickered outer edges 734 to engage the wellbore. The first slips 707 of this embodiment may further include at least one cavity as discussed above with respect to FIGS. 21A-21D.

Anchoring assembly 733 also includes a first cone 709 arranged adjacent to the first plurality of slips 707. A portion of first slips 707 rests on first cone 709 as shown in FIG. 28. First cone 709 may be comprised of non-metallic composite materials such as phenolics, plastics, or continuous wound carbon fiber that are easily removable by milling or drilling, for example. First cone 709 may also be comprised of metallic materials such as cast iron.

The inner surface of first cone 709 may match the cross-section of mandrel 714. The inner surface of first cone 709 may be circular. However, as stated above, in this embodiment, the mandrel 714 may or may not have a circular cross-section. If mandrel 714 has a non-circular cross-section, the matching surface of cone 709 creates a advantageous rotational lock therebetween. As discussed above, if a non-circular mandrel used, the non-circular inner surface of cone 709 may be hexagonal or any configuration matching the cross-section of mandrel 714, as would be understood by one of ordinary skill in the art with the benefit of this disclosure.

First cone 709 may include a plurality of slots disposed therein which weaken first cone 709 at a predetermined force identical to those slots shown in FIG. 4 and described above. In some embodiments, when first cone 709 collapses, the remaining debris of the first cone tightly surround the mandrel 714 to preclude movement between anchoring assembly 733 and mandrel 714.

One or more shearing devices, for example shear pins 408, may extend between first cone 709 and mandrel 714. Shear pins 408 preclude the premature setting of anchoring assembly 733 in the wellbore during run-in. Shear pins 408 may be designed to shear at a predetermined force. For example, shear pins 408 may shear at a force of approximately 1500 pounds; however, shear pins 408 may be designed to shear at any other desirable force. As shear pins 408 shear, further increases in force on first cone 709 will cause relative movement between first cone 709 and first slips 707. As discussed above with respect to FIG. 6, the relative movement between first cone 709 and first slips 707 causes first slips 707 to move in a radially-outward direction and into engagement with the casing wall. At some point of the travel of first slips 707 along first cone 709, slip ring 706 will break to allow each of first slips 707 to engage the casing wall. For example, slip ring 706 may break between 1500 and 3000 pounds, with slips 407 being fully engaged with the casing wall at 3000 pounds (similar to that shown in FIGS. 6 and 12.).

First cone 709 may abut a push ring 705 in some embodiments. Push ring 705 may be non-metallic, comprised, for example, of molded phenolic or molded carbon reinforced PEEK. Push ring 405 may include an inner surface that may be circular, or that may be non-circular which precludes rotation between the push ring 705 and a mandrel 714 with a non-circular cross-section. For example the inner surface of push ring 705 may be hexagonal, matching a hexagonal outer surface of mandrel 714.

As described above, packing element 710 may include three or four independent pieces. Packing element 710 may include first and second end elements 44 and 46 with an elastomeric portion 48 disposed therebetween. In the embodiments shown in FIG. 28, packing element 710 further includes booster ring 745 disposed between elastomeric portion 48 and first end element 44. Booster ring 745 may be utilized in high pressure applications to prevent leakage. Booster ring 745 acts to support elastomeric portion 48 of packing element 710 against mandrel 714 in high pressure situations. As described above, the packing element 710 may have a non-constant cross-sectional area. During operation, when buckling the packing element 710, the packing element 710 is subject to uneven stresses. Because the booster ring 745 has a smaller mass than the packing element 710, the booster ring 745 will move away from the mandrel 714 before the packing element 710; thus the booster ring 745 will contact the casing prior to the packing element 710 contacting the casing. This action wedges the packing element 710 tightly against the casing, thus closing any potential leak path caused by the non-constant cross section of the packing element 710. The packing element 710 may also include a lip (not shown) to which the booster ring 745 abuts in operation.

Booster ring 745 may have a circular inner surface in this embodiment which circumscribes a circular mandrel. Alternatively, booster ring 745 may include a non-circular inner surface that may correspond to the cross-section of a non-circular mandrel 714, for example, hexagonal. In these embodiments, the match between the non-circular surface of booster ring 745 and the cross-section of mandrel 714 advantageously precludes rotation between the packing element and the mandrel as shown in any of FIGS. 14-17 and 22, and as described above.

Elastomeric portion 48 of packing element 710 comprises a radial groove to accommodate an O-ring 711 which surrounds mandrel 714 to assist in securing elastomeric portion 48 at a desired location on mandrel 714. First and second end elements 44 and 46 may include a wire mesh encapsulated in rubber or other elastomeric material. Packing element 710 may include a circular cross-section; alternatively, packing element 710 may have a non-circular inner surface that may match the cross-section of a non-circular mandrel 714 thus creating a rotational lock, as described above and shown in FIGS. 14-17. For example, the surface of packing element 410 may be hexagonal, while mandrel 714 has an outer surface that is octagonal, but rotation between the two is still precluded.

Packing element 710 is predisposed to a radially outward position as force is transmitted to the end elements 44 and 46, urging elastomeric portion 48 of packing element 710 into a sealing engagement with the casing wall and the outer surface of mandrel 714. Elastomeric portion 48 of packing element 710 may seal against the casing wall at, for example, 5000 pounds.

End element 46 of packing element 710 abuts anchoring assembly 785. The anchoring assembly 785 may comprise a second cone 784, which may be metallic or non-metallic.

Second cone 784 may be comprised of metallic materials that are easily drillable, such as cast iron, or of non-metallic composite materials that are easily drillable such as phenolics, plastics, or continuous wound carbon fiber. Second cone 784 is a part of anchoring assembly 785. Second cone 784, similar to first cone 709, may include a non-circular inner surface matching the cross-section of mandrel 714, as described above, to create a rotational lock. In one embodiment, second cone 784 does not include any longitudinal slots as first cone 709 does; however, in an alternative embodiment second cone 784 does include the same elements as first cone 709. Second cone 784 includes one or more shearing devices, for example shear pins 508, that prevent the premature setting of a second plurality of slips 782. Shear pins 508 may shear at, for example approximately 1500 pounds.

As discussed above with respect to the cones shown in FIG. 4, second cone 784 may include a plurality of channels formed therein. Each of channel is associated with its respective second slip 782. The channels (99 in FIG. 4) advantageously create a rotational lock between second slips 782 and second cone 784.

Anchoring assembly 785 further includes the second plurality of slips 782 arranged about the outer diameter of mandrel 414 in a fashion similar to that of the first plurality of slips 707. Second slips 507 (like slips 18 in FIG. 3) are arranged in a ring with the slips being attached to one another by slip ring 781. Similar to the embodiment shown in FIG. 3, there may be six slips 782 arranged in a hexagonal configuration to match the cross-section of mandrel 714, which may be circular or non-circular in this embodiment. It will be understood by one of skill in the art with the benefit of this disclosure that second slips 782 may be arranged in any configuration matching the cross-section of mandrel 714, which may advantageously create a rotational lock, as described above.

Each of second slips 782 may be constructed of non-metallic composite materials such as injection molded phenolic or may be metal such as cast iron. Also, each second slip 782 may be molded or machined to have rough or wickered outer edges 434 to engage the wellbore. Each second slips 782 of this embodiment may further include at least one cavity as discussed above with respect to FIGS. 21A-21D. Further, each second slip 782 may include a metallic inserts disposed in outer surface (shown as inserts 22 in FIG. 1).

Adjacent second slips 782 is a second push ring 787. Push ring 787 may be metallic, such as cast iron, or non-metallic, e.g. molded plastic, phenolic, or molded carbon reinforced PEEK. Push ring 787 may be a solid piece with an inner surface that may match the cross-section of mandrel 714, similar to the construction of push ring 705 discussed above. Push ring 787 abuts a upper end cap 788. Upper end cap 788 may be any easily-millable material, such as metallic material (cast iron) or non-metallic material (e.g. injection molded phenolic, plastic, molded carbon reinforced PEEK, or other similar material). Upper end cap 788 may be attached to mandrel 714 by a plurality of pins tangential pins 704, and/or attached via an adhesive, for example. Tangential pins 704 are arranged in different planes to distribute any shear forces transmitted thereto and may be any metallic material or non-metallic composite that is easily millable, for example an injection molded phenolic, or molded carbon-reinforced PEEK, or other similar materials.

Upper end cap 788 prevents any of the other Frac Plug 700 components (discussed above) from sliding off the upper end of mandrel 714. In the embodiment shown in the figures, upper end cap 788 exhibits an internal surface matching the cross-section of mandrel 714, which may be circular or non-circular. When a mandrel 714 with a non-circular cross-section is utilized, the mating internal surface of upper end cap 788 creates a rotational lock, as described above.

The upper end of mandrel 714 may include a locking mechanism, for example tapered surface that rotationally locks Frac Plug assembly 700 with another abutting plug assembly (not shown) as described above. Attached to the upper end of Frac Plug 700 is release stud 701 of a wireline adapter kit 798.

As shown in FIGS. 28-30, the Frac Plug assembly 700 further comprises a valve having a flapper 750 pivotally attached to the mandrel 714 by a hinge 740. Hinge 740 may be circumscribed by a spring (not shown) to bias the flapper 750 in a closed position. Thus, fluids from within the wellbore are able to pass upwardly through the passage 731 when the downhole pressure applies an upward force on the flapper sufficient to overcome the force the spring exerts on the flapper in a downward direction. Further, as the flapper 750 is biased in the closed position, the flapper seals 750 the passage such that fluid flow from above the flapper 750 is prevented from flowing into the passage 731 in mandrel 714 below.

In this embodiment, the flapper 750 further comprises at least one tab 760, as shown in cross section in FIG. 29B. Additionally, the mandrel 714 further comprises at least one recess 770 in the mandrel 714 to mate with the at least one tab 760 when the valve having the flapper 750 is closed. In this configuration, the flapper 750 is rotationally locked (even though both the mandrel 714 and the flapper 750 have circular cross sections) to the mandrel 714, as the at least one tab 760 mates with the at least one recess 770. Thus, when it is desired to subsequently remove the downhole tool, the flapper 750 is prevented from rotating with the mill or drill bit, thus facilitating the removal of the flapper.

Other embodiments of the flapper 750 may be utilized which also provide a rotational lock with the mandrel. For example, as shown in FIG. 29C, the flapper 750 is comprised of a non-circular cross section (shown as an oval by way of example in FIG. 29C) which mates with a complementary non-circular cross section of the mandrel 714 (shown here as an oval by way of example only). Thus, in this configuration, the flapper 750 is rotationally locked to the mandrel 714, as their cross sections are non-circular and complementary which prevents the flapper 750 from rotating with the mill or drill bit during removal.

FIG. 29D shows another embodiment of the flapper 750 in which the flapper 750 has multiple protrusions or teeth 751 located on the periphery which mate with multiple recesses 760 in the mandrel 714. Again, the milling or drilling out of the flapper 750 is facilitated by the rotational lock provided by the multiple tabs 751 mating with the multiple recesses. Other embodiments to provide the rotational lock between the mandrel 714 and the flapper 750 include providing a frictional lock between the two, e.g. by applying a sand-like gritty surface to the periphery of the flapper to rotationally lock flapper 750 to mandrel 714. In summary, any type of configuration with provides a rotational lock to facilitate subsequent removal, known to one of ordinary skill in the art having the benefit of this disclosure, may be utilized.

The flapper 750 may be metallic, or may be non-metallic to facilitate the subsequent removal of the tool. The flapper 750 may be comprised on non-metallic fiber-reinforced thermoset, fiber reinforced thermoplastic, a structural grade plastic material, or any other easily-milled material known by those of ordinary skill in the art having the benefit of this disclosure. This allows the flapper 750 to have less mass and less inertia a metallic flapper, which also provides a faster response time from the valve.

It will be understood by one of skill in the art with the benefit of this disclosure that one or more of the non-metallic components may include plastics that are reinforced with a variety of materials. For example, each of the non-metallic components may comprise reinforcement materials including, but not limited to, glass fibers, metallic powders, wood fibers, silica, and flour. However, the non-metallic components may also be of a non-reinforced recipe, for example, virgin PEEK, Ryton, or Teflon polymers. Further, in some embodiments, the non-metallic components may instead be metallic component to suit a particular application. In a metallic-component situation, the rotational lock between components and the mandrel remains as described above.

Operation and setting of the Frac Plug assembly 700 is as follows. Frac Plug assembly 700, attached to the release stud 701 via pins 503, is lowered into a wellbore to the desired setting position. A setting sleeve supplies a downhole force on upper push ring 787 to shear pins 508 of second cone 784. At a predetermined load, for example a load of approximately 1500 pounds, shear pins 508 shear and the elastomeric portion 48 of packing element 710 begins its radial outward movement into sealing engagement with the casing wall. As the setting force from the setting sleeve increases and the elastomeric portion 48 of packing element 710 is compressed, the slip ring 706 breaks and the second plurality of slips 782 traverse second cone 784. Eventually each of second plurality of slips 782 continue to traverse second cone 784 until the wickered edges 534 (or metallic inserts, if used) of each slip 782 penetrates the casing wall.

Similar to the operation of the second anchoring assembly 785, the load transmitted by the setting sleeve also causes shear pins 408 between first cone 709 and mandrel 714 to shear at, for example, approximately 1500 pounds, and allow first plurality of slips 707 to traverse first cone 709. First plurality of slips 707 traverse first cone 709 and eventually first slip ring 706 breaks and each of first plurality of slips 707 continue to traverse first cone 709 until wickered surface 534 (or metallic inserts if used) of each slip penetrates the casing wall. Force supplied through the setting sleeve (not shown) continues and at, for example, approximately 3000 pounds of force, first and second pluralities of slips 707 and 782 are set in the casing wall.

In some embodiments, as the force transmitted by the setting sleeve continues to increase, eventually first cone 709 and second cone 782 may deflect around mandrel 714. First cone 709 and second cone 782 may deflect, for example, at approximately 4500 pounds. As first cone 709 and second cone 782 deflect around mandrel 714, mandrel 714 is locked in place with respect to the outer components. Force may continue to increase via the setting sleeve to further compress packing element 710 into a sure seal with the casing wall. Packing element 710 may be completely set at, for example approximately 25,000 pounds.

In some embodiments, as the force transmitted to the setting sleeve continues to increase eventually release sleeve 789 breaks so that the wire line adapter kit 798 may be retrieved, leaving the Frac Plug assembly 700 set in the wellbore.

Once set, the Frac Plug assembly 700 operates as a typical frac plug, preventing fluid flow downwardly through the plug, while selectively allowing fluid passage upwardly through the tool as described above. Further, because Frac Plug assembly 700 may include non-metallic components, Frac Plug assembly 700 may be easily drilled or milled out as desired with only a coiled tubing drill bit and motor or with a mill, for example. The at least one tab 760 on flapper 750 engaging the at least one recess 770 in mandrel 714 prevents rotation of the flapper 750 during milling or drilling out, further facilitating removal.

FIG. 28 shows the Frac Plug assembly 700 in the run-in position attached to the Wireline Adapter Kit 798 and setting tool 701. As can be seen, the Frac Plug assembly 700 is shown assembled to the Wireline Adapter Kit and Setting Tool for run-in. The flapper 750 of the valve is held open in this position by the Wireline Adapter Kit 798.

FIG. 29 shows the Frac Plug assembly 700 with pressure (P) being applied from above the flapper 750, with the pressure and the spring on hinge 740 operating to close the valve to prevent fluid flow from above the Frac Plug assembly 700 downhole. The Frac Plug assembly 700 is shown set in casing with pressure (P) from above. The flapper valve is normally held in a closed position similar to this by the action of a spring. In this position, the flapper 750 will hold pressure from above. The composite material of the flapper 750 when pressed against the composite material of the mandrel is sufficient to provide a seal. Alternative embodiments of the sealing means may include elastomeric coatings, such as rubber, e.g., on the flapper 750 or on the mandrel 740 or both. As described above, the tabs 760 on flapper 760 prevent rotation of the flapper 760 during mill-out.

FIG. 30 shows the Frac Plug assembly 700 set in the casing with pressure (P) from below. The pressure (P) from the wellbore overcomes the biasing force of the spring to open the valve, thus allowing fluid to pass upwardly through the passage 731 of the Frac Plug assembly 700.

While the above description regarding the flapper 750 having at least one tab 760 is described in relation to a frac plug, it would be apparent to one of ordinary skill in the art having the benefit of this disclosure that the downhole tool described above is not limited to frac plugs; rather, the invention disclosed could be utilized in any number of applications, including but limited to frac plugs, surge tools, cement retainers, and safety valves. For instance, and not by way of limitation, if the flapper valve were inverted, the downhole tool could operate as a cement retainer to selectively allow fluid flow downwardly through the tool, while preventing fluid flow upwardly through the tool.

Referring to FIGS. 31-34, another embodiment of the present invention is shown as a Cross-Flow Frac Plug assembly 800. Construction and operation of the embodiment shown in FIGS. 31-34 is identical to those of the embodiment of FIGS. 28-30 with the exception of the operation of the central member 810 discussed below. It should also be noted that the operation and functioning of the Cross-Flow Frac Plug assembly 800 is not dependent upon the valve having a flapper 750 with at least one tab 760, nor a mandrel 714 having a recess 770, as the Cross-Flow Frac Plug assembly 800 may also be used in conjunction with prior art flapper valves.

The Cross-Flow Frac Plug assembly 800 in this embodiment is suitable for use in as "timed" plug, which may be utilized as a bridge plug when initially set downhole to prevent fluid flow through the assembly; then, upon selectively actuating the assembly as described herein, the assembly 800 may be utilized as a frac plug to selectively control the flow of fluids through the Cross-Flow Frac Plug assembly 800. Thus, one tool may be utilized instead of two separate tools. Further, as the first tool does not have to be removed prior to the setting of the second, time is saved by utilizing the Cross-Flow Frac Plug assembly 800.

Figure 31B:
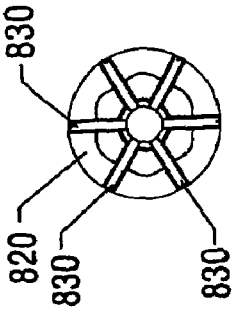
FIG. 31B shows a release mechanism of one embodiment of a Cross-Flow Frac Plug assembly 800.
Figure 31A:
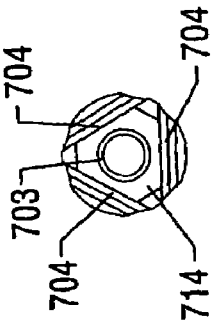
FIG. 31A shows the tangential pins of an embodiment of a Cross-Flow Frac Plug assembly 800.
Figure 31:
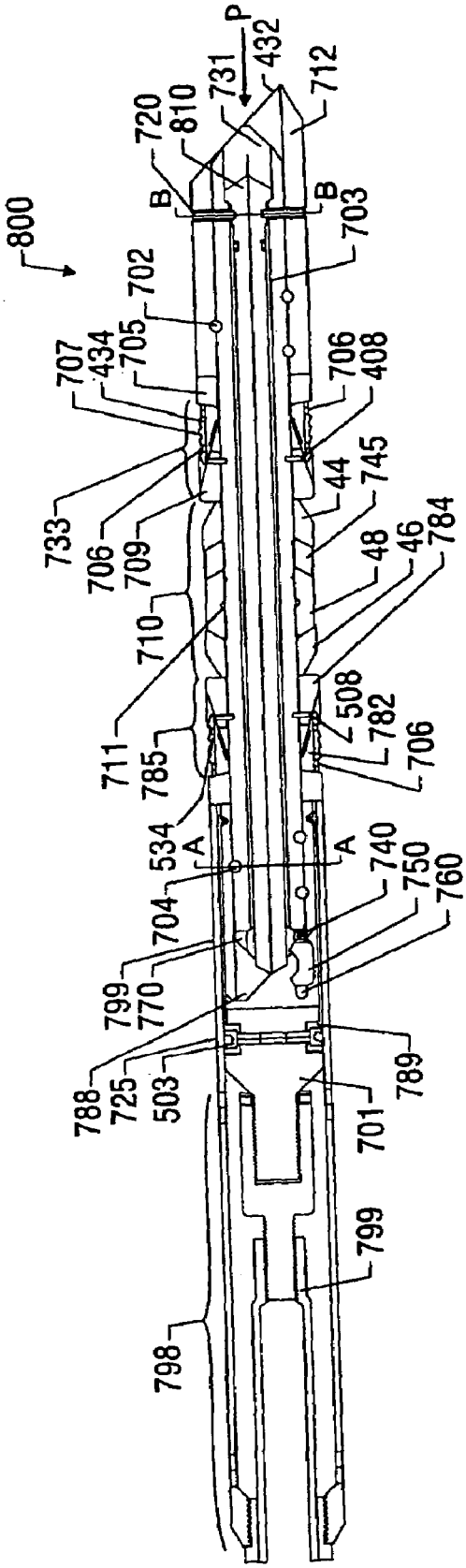
FIG. 31 shows an embodiment of a downhole tool such as a Cross-Flow Frac Plug assembly 800 being run in hole.
Figure 32:
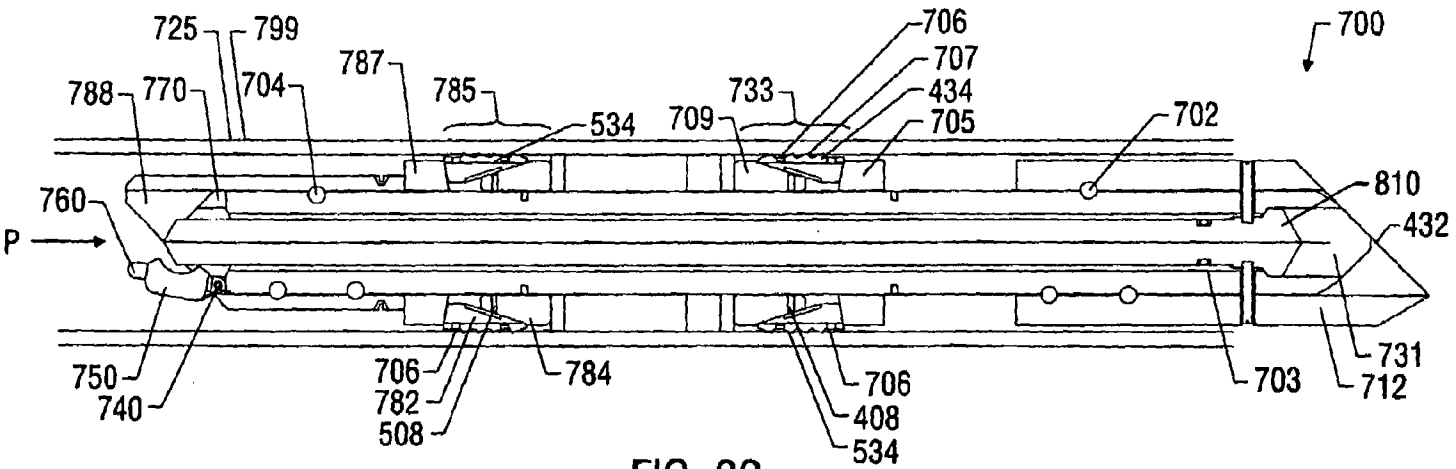
FIG. 32 shows the Cross-Flow Frac Plug assembly 800 of FIG. 31 having a pressure (P) supplied from above.
Figure 33:
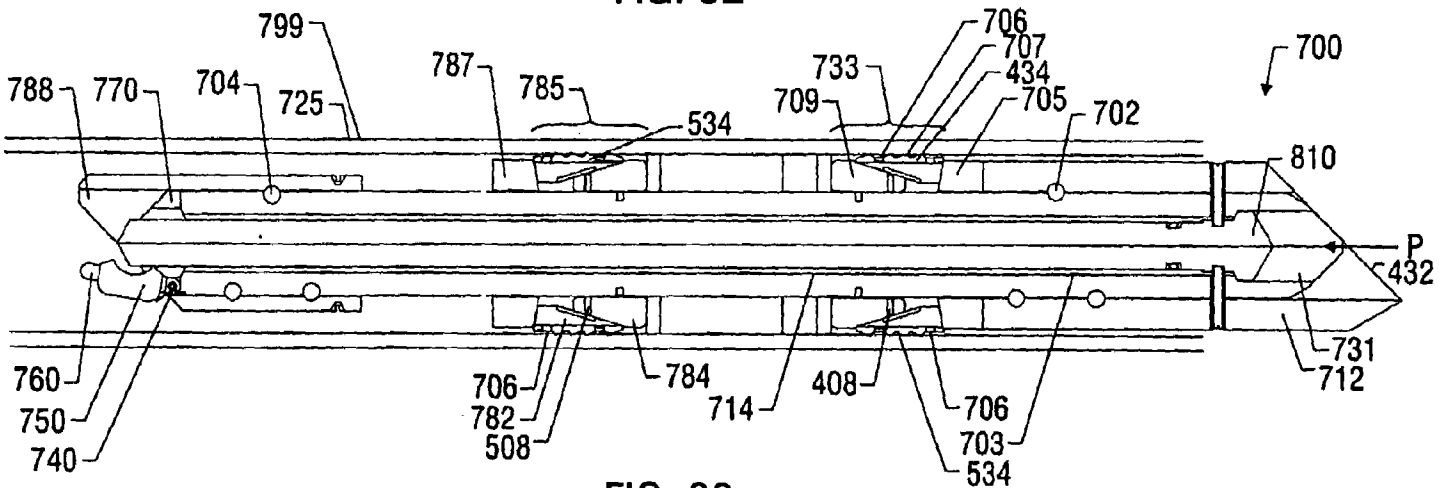
FIG. 33 shows the Cross-Flow Frac Plug assembly 800 of FIG. 31 having a pressure (P) supplied from below.

The Cross-Flow Frac Plug assembly 800 in this embodiment comprises the valve having a flapper 750 as shown in FIG. 31. A central member 810 is releaseably attached within the mandrel 714. The central member 810 operates to holds the flapper 750 of the valve open during run-in and setting of the Cross-Flow Frac Plug assembly 800 as shown in FIG. 31. In this configuration (i.e. when the central member 810 is within the mandrel 714), the central member 810 also sealing engages the mandrel 714 to prevent against fluid bypass through passage 731 from either direction, i.e. cross-flow. The central member 810 is releaseably secured within the mandrel 714 by a release mechanism 820. In this configuration, the Cross-Flow Frac Plug assembly 800 acts as a conventional bridge plug preventing cross-flow whether pressure (P) is supplied from above (as shown in FIG. 32) or from below (as shown in FIG. 33).

Figure 34:
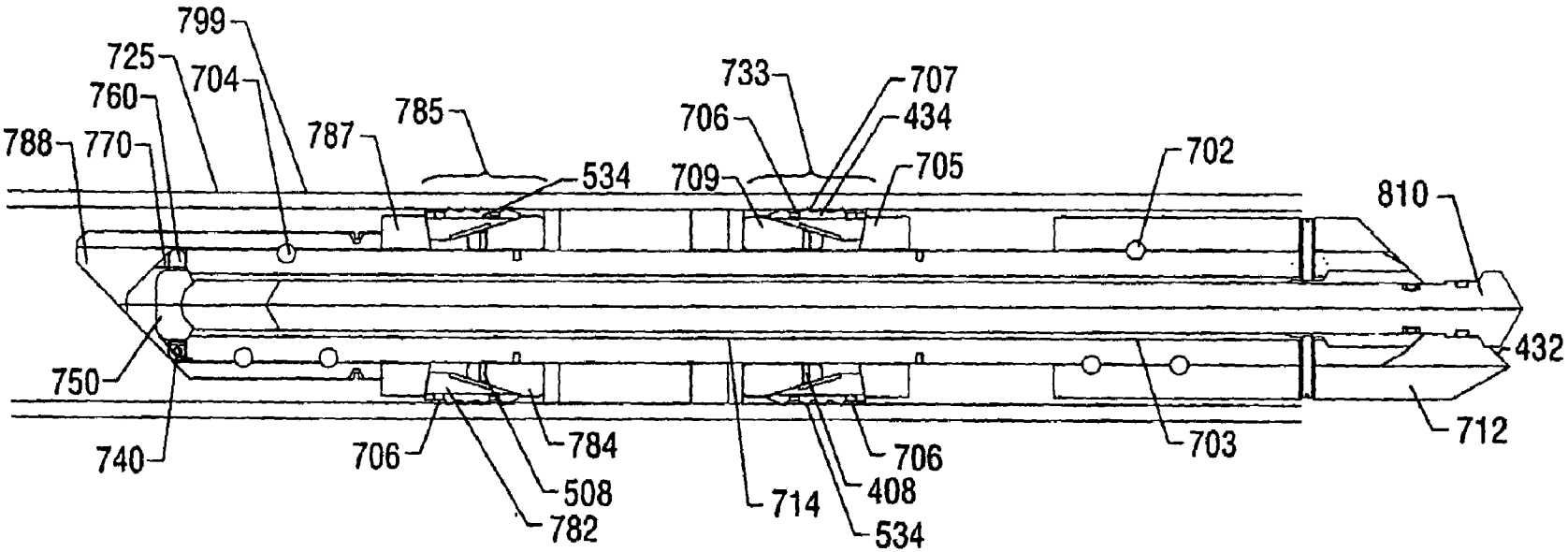
FIG. 34 shows the Cross-Flow Frac Plug assembly with a central member 810 being released.

As shown in FIG. 34, once adequate pressure (P) is applied to the top of the Cross-Flow Frac Plug assembly 800, the central member 810 is released allowing fluid flow through passage 731 of mandrel 714. Once the central member 810 is released, operation of the flapper 750 (as described above) allows the Cross-Flow Frac Plug assembly 8000 to act as a typical frac plug, controlling fluid flow through passage 731 as described above. FIG. 34 shows the flapper 750 biased in the closed position by the spring (not shown) as described above with respect to FIGS. 28-30.

The release mechanism 820 is adapted to be adjustable for release of the central member 810 at a desired force or pressure. Referring again to FIGS. 32 and 33, pressure (P) from above or below (respectively) the Cross-Flow Frac Plug assembly 800 plug acts has not reached a threshold pressure to release central member 810. Referring to FIG. 34, when downward pressure (P) increases to the desired value, the central member 820 is being released from within the mandrel 714 and falls downhole.

Now referring to FIG. 31A shows a cross-sectional view of that portion of the Cross-Flow Frac Plug assembly 800 having tangential pins 704. FIG. 31B shows one embodiment of the release mechanism 820 of one embodiment of the present invention. This release mechanism 820 may be comprised of an array of shear screws 830 as shown in FIG. 31B. By increasing or decreasing the number of shear screws utilized, the shear force required to selectively release the central member from within the mandrel 714 of the Cross-Flow Frac Plug assembly 800 may be altered for particular applications. Alternative embodiments of release mechanism 820 include, but are not limited to, shear rings, adjustable spring-loaded detent pints, or rupture disks. Any mechanical means of releasing the central member 810 by hydraulic pressure may be utilized.

Figure 35A:
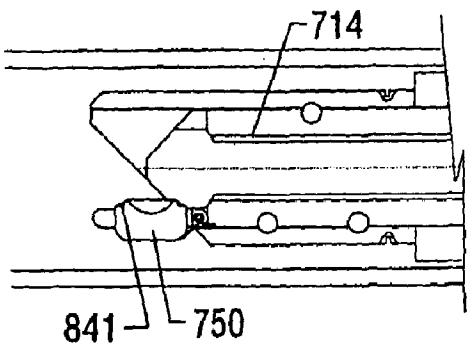
FIGS. 35A, 35B, 36A, 36B, 37A, and 37B show various embodiments of a seal for the Cross-Flow Frac Plug assembly 800.
Figure 35B:
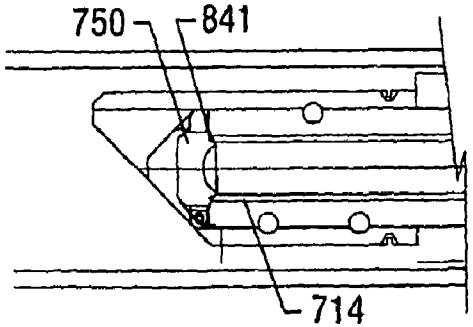
Figure 36A:
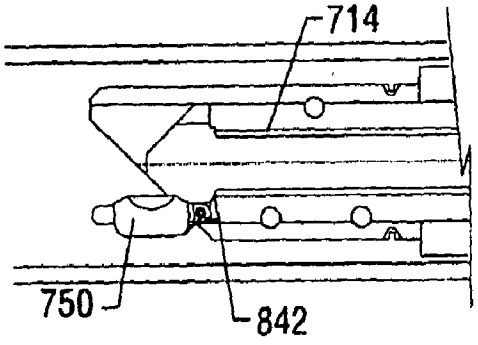
Figure 36B:
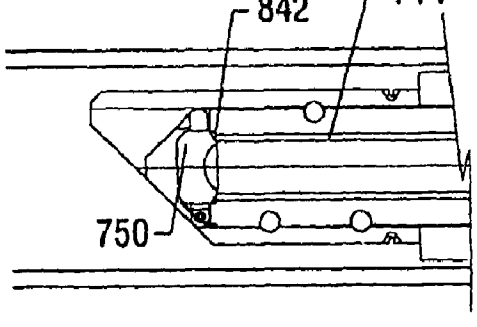
Figure 37A:
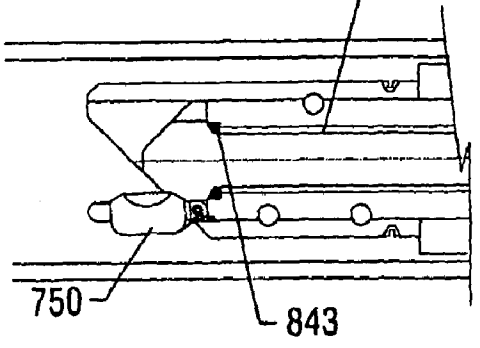
Figure 37B:
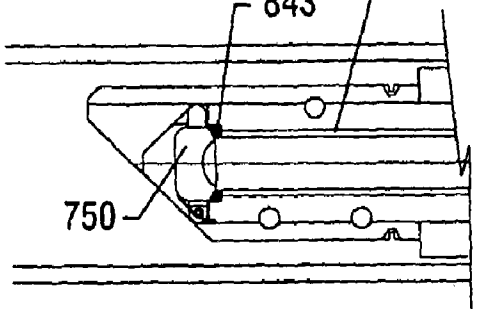

FIGS. 35A, 35B, 36A, 36B, 37A, and 37B shown alternative embodiments of seal 840. FIGS. 35A and 35B shows the seal 840 being comprised of a bonded seal 841 on the lower periphery of the flapper 750 to seal the flapper 750 against the mandrel 714 when the valve is closed, as shown in FIG. 35B. FIGS. 36A and 36B show the seal 840 being comprised of an O-Ring 842 fixedly attached to the mandrel 814, to seal the flapper 750 against the mandrel 714 when the valve is closed, as shown in FIG. 36B. FIGS. 37A and 37B show the seal 840 being comprised of an elastomeric sealing element 843 bonded to the mandrel 714. The examples of seal are provided for illustration only, and the invention is not so limited: Any seal 840 known to one of ordinary skill in the art having benefit of this disclosure may be utilized.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed methods and apparatus may be utilized in various combinations and/or independently. Thus the invention is not limited to only those combinations shown herein, but rather may include other combinations.

What is claimed is:

1. A subterranean apparatus comprising:

a hollow mandrel having an inner diameter defining a passage therethrough;

a packing element arranged about the mandrel; and a valve functionally associated with the mandrel for selectively controlling flow of fluids through the passage, the valve having a flapper with a non-circular cross section adapted to selectively engage the mandrel such that rotation between the mandrel and the valve is precluded when the valve is in a closed position.

2. The apparatus of claim 1 wherein the flapper having the non-circular cross section is adapted to selectively engage the inner diameter of the mandrel, the inner diameter of the mandrel being non-circular, when the valve is in the closed position.

3. The apparatus of claim 1 in which the valve has at least one tab adapted to selectively engage at least one recession in the mandrel when the valve is in the closed position.

4. The apparatus of claim 3 in which the valve has a hinge to pivotally attach the flapper to the mandrel.

5. The apparatus of claim 3 wherein the flapper is biased in the closed position by a spring.

6. The apparatus of claims 1 or 3 wherein the valve further comprises a seal to sealingly engage the flapper and the mandrel when the valve is in the closed position.

7. The apparatus of claim 6 wherein the seal comprises a bonded seal on the flapper.

8. The apparatus of claim 6 wherein the seal comprises an O-ring on the mandrel.

9. The apparatus of claim 6 wherein the seal comprises an elastomeric sealing element functionally associated with the mandrel.

10. The apparatus of claim 2 or 3 wherein the flapper is comprised of non-metallic material.

11. The apparatus of claim 3 or 10 wherein the non-metallic material is fiber-reinforced thermoset, fiber reinforced thermoplastic, or structural grade plastic.

12. The apparatus of claim 1 further comprising a central member within the passage of the mandrel, the central member being selectively releasable from the apparatus.

13. The apparatus of claim 12 wherein the central member is releaseably attached to the mandrel by a release mechanism.

14. The apparatus of claim 13 wherein the release mechanism is comprised of shear screws.

15. The apparatus of claim 12 wherein the release mechanism is comprised of shear rings, adjustable spring-loaded detent pins, or rupture disks.

16. The apparatus of claim 1 wherein the mandrel has an outer surface, the mandrel having a non-circular cross-section, the packing element having a non-circular inner surface such that rotation between the mandrel and the packing element is precluded, the outer surface of the mandrel and the inner surface of the packing element interfering with one another in rotation.

17. The apparatus of claim 16 wherein the mandrel comprises non-metallic materials.

18. The apparatus of claim 16 in which the mandrel is comprised of a metallic core wound with thermoplastic tape.

19. The apparatus of claim 18 wherein the metallic core is comprised of brass and the tape is reinforced with carbon fiber.

20. The apparatus of claim 16 further comprising an anchoring assembly arranged about the mandrel, the anchoring assembly having a non-circular inner surface such that rotation between the mandrel and the anchoring assembly is precluded.

21. The apparatus of claim 20 wherein the anchoring assembly further comprises:

a first plurality of slips arranged about the non-circular mandrel outer surface, the slips being configured in a non-circular first loop such that rotation between the mandrel and the first plurality of slips is precluded by interference between the first loop and the mandrel outer surface;

a first slip ring surrounding the first plurality of slips to detachably hold the first plurality of slips about the mandrel;

a second plurality of slips arranged about the non-circular mandrel outer surface, the second plurality of slips being configured in a second non-circular loop such that concentric rotation between the mandrel and the second loop is precluded by interference between the second loop and the mandrel outer surface; and a second slip ring surrounding the second plurality of slips to detachably hold the second plurality of slips about the mandrel.

22. The apparatus of claim 21 wherein each the first plurality of slips and second plurality of slips each contain a cavity.

23. The apparatus of claim 22 further comprising:

a first cone arranged about the non-circular outer surface of the mandrel, the first cone comprising a non-circular inner surface such that rotation between the mandrel and first cone is precluded, wherein a second plurality of slips abuts the first cone, facilitating radial outward movement of the slips into engagement with the wellbore wall upon traversal of the first plurality of slips along the first cone;

a second cone arranged about the non-circular outer surface of the mandrel, the second cone comprising a non-circular inner surface such that rotation between the mandrel and second cone is precluded, wherein a second plurality of slips abuts the second cone, facilitating radial outward movement of the slips into engagement with the wellbore wall upon traversal of the second plurality of slips along the second cone, the first and second cones each comprising a plurality of channels, each of the plurality of channels being receptive of at least one of the plurality of slips, the channels being arranged such that rotation between the first cone and the first slips is precluded, and the second cone and the second slips is precluded.

24. The apparatus of claim 16 wherein the packing element further comprises a first end element, a second end element, and an elastomer disposed therebetween.

25. A method of selectively isolating a portion of a well comprising the steps of:

providing an apparatus having a hollow mandrel with an inner diameter defining a passage therethrough, the inner diameter of the mandrel having a non-circular cross section, a packing element arranged about the mandrel, and a valve functionally associated with the mandrel for selectively controlling flow of fluids through the passage, the valve having a flapper with a non-circular cross section, adapted to engage the inner diameter of the mandrel such that rotation between the mandrel and the valve is precluded when the valve is in a closed position;

running an apparatus into a well, setting the packing element by the application of a force;

selectively controlling a flow of fluid through the apparatus by the valve; and destructively removing the apparatus including the valve out of the well.

26. The method of claim 25 in which the step of providing an apparatus further comprises providing the apparatus with a flapper having at least one tab, the mandrel having at least one recession, and further comprising:

closing the valve, the at least one tab engaging the at least one recession when the valve is closed.

27. The method of claim 26 further comprising:

sealing the valve against the mandrel when the valve is closed with a seal.

28. A method of selectively isolating a portion of a well comprising the steps of:

providing an apparatus having a hollow mandrel with an inner diameter defining a passage therethrough, a packing element arranged about the mandrel, and a valve functionally associated with the mandrel for selectively controlling flow of fluids through the passage, the valve having a flapper having a non-circular cross section, adapted to engage the inner diameter of the mandrel such that rotation between the mandrel and the valve is precluded when the valve is in a closed position;

running an apparatus into a well, setting the packing element by the application of a force;

selectively controlling a flow of fluid through the apparatus by the valve; and destructively removing the apparatus including the valve out of the well, by milling the apparatus out of the well, the flapper of the apparatus being comprised of non-metallic material to facilitate the milling.

29. The method of claim 26 in which the step of providing an apparatus further comprises providing the apparatus with a central member, the method further comprising:

preventing fluid flow through the apparatus by the central member.

30. The method of claim 29 further comprising:

selectively releasing the central member from the passage of the apparatus; and controlling fluid flow through the apparatus with the valve.

31. The method of claim 30 further comprising:

selectively operating a release mechanism to selectively release the central member.

32. The method of claim 31 in which the step of providing an apparatus includes providing the apparatus with the mandrel having an outer surface and a non-circular cross-section, the packing element having a non-circular inner surface such that rotation between the mandrel and the packing element is precluded, the outer surface of the mandrel and inner surface of the packing element interfering with one another in rotation.

33. The method of claim 32 further comprising:

locking an anchoring assembly of the apparatus to the mandrel to lock the apparatus in place within the well.

34. A subterranean apparatus comprising:

a hollow mandrel having an inner diameter defining a passage therethrough;

a packing means arranged about the mandrel; and a valve functionally associated with the mandrel for selectively controlling flow of fluids through the passage, the valve having means for engaging the mandrel such that rotation between the mandrel and the valve is precluded when the valve is in a closed position to facilitate subsequent removal of the apparatus, the means for engaging the mandrel being a flapper with a non-circular cross section adapted to selectively engage the mandrel, the apparatus having a central member within the passage of the mandrel, the central member having selective releasing means.

35. The apparatus of claim 34 further comprising means for anchoring the apparatus in a wellbore.

* * * * *